US010473374B2

(12) United States Patent
Ohura et al.

(10) Patent No.: US 10,473,374 B2
(45) Date of Patent: Nov. 12, 2019

(54) REFRIGERATION APPARATUS FOR OIL AND DEFROST CONTROL

(71) Applicant: DAIKIN INDUSTRIES, LTD., Osaka-shi, Osaka (JP)

(72) Inventors: Ryuuta Ohura, Osaka (JP); Junya Minami, Osaka (JP)

(73) Assignee: Daikin Industries, Ltd., Osaka (JP)

( * ) Notice: Subject to any disclaimer, the term of this patent is extended or adjusted under 35 U.S.C. 154(b) by 0 days.

(21) Appl. No.: 16/035,312

(22) Filed: Jul. 13, 2018

(65) Prior Publication Data

US 2018/0328636 A1 Nov. 15, 2018

Related U.S. Application Data

(63) Continuation of application No. PCT/JP2017/000648, filed on Jan. 11, 2017.

(30) Foreign Application Priority Data

Jan. 15, 2016 (JP) ..... 2016-005927

(51) Int. Cl.
*F25B 47/02* (2006.01)
*F24F 11/89* (2018.01)
(Continued)

(52) U.S. Cl.
CPC ..... *F25B 47/02* (2013.01); *F24F 11/89* (2018.01); *F25B 31/004* (2013.01);
(Continued)

(58) Field of Classification Search
CPC ..... F25B 47/02; F25B 47/022; F25B 31/004; F25B 47/025; F25B 49/02;
(Continued)

(56) References Cited

U.S. PATENT DOCUMENTS 5,467,604 A * 11/1995 Sekigami ..... F24F 3/065 62/117
5,694,782 A * 12/1997 Alsenz ..... F25B 5/02 62/156
(Continued)

FOREIGN PATENT DOCUMENTS

CN 202303691 U 7/2012
JP 2-195145 A 8/1990
(Continued)

OTHER PUBLICATIONS

Extended European Search Report dated Dec. 3, 2018 in corresponding European Application No. 17738440.1.
(Continued)

*Primary Examiner* — Travis C Ruby
(74) *Attorney, Agent, or Firm* — Birch, Stewart, Kolasch & Birch, LLP

(57) ABSTRACT

Provided is a refrigeration apparatus in which a decrease in a temperature of an indoor heat exchanger can be suppressed as much as possible while depletion of refrigerator oil in a compressor is also suppressed. An air-conditioning apparatus configured from a parallel connection of a plurality of outdoor units to an indoor unit, wherein when a predetermined defrosting condition has been fulfilled, a controller includes at least one processor programmed to selectively execute a reverse-cycle defrost mode when a predetermined outflow condition pertaining to an outflow integrated quantity of refrigerator oil has also been fulfilled, and selectively execute an alternating defrost mode, in which the outdoor unit that is to be defrosted is changed in sequence, when the predetermined outflow condition has not been fulfilled.

4 Claims, 9 Drawing Sheets

(51) Int. Cl.
*F25B 31/00* (2006.01)
*F25B 49/02* (2006.01)

(52) U.S. Cl.
CPC ..... *F25B 47/025* (2013.01); *F25B 49/02* (2013.01); *F25B 2313/0253* (2013.01); *F25B 2347/021* (2013.01)

(58) Field of Classification Search
CPC .... F25B 2313/0253; F25B 2313/02332; F25B 2313/0251; F25B 2313/02542; F25B 2347/021; F25B 2700/03; F25B 2700/11; F24F 11/89; F24F 11/42
See application file for complete search history.

(56) References Cited

U.S. PATENT DOCUMENTS 5,970,727 A * 10/1999 Hiraoka ..... F25B 13/00 62/156
2002/0129612 A1* 9/2002 Saikusa ..... F25B 31/002 62/192
2004/0016241 A1* 1/2004 Street ..... F25B 49/02 62/129
2004/0016244 A1* 1/2004 Street ..... F25B 49/02 62/132
2005/0044861 A1* 3/2005 Cho ..... F25B 13/00 62/81
2005/0103035 A1* 5/2005 He ..... F25B 31/002 62/192
2008/0072611 A1* 3/2008 Ahmed ..... F25B 49/02 62/175
2010/0123016 A1* 5/2010 Douglas ..... F25B 13/00 236/49.3
2011/0174005 A1* 7/2011 Takegami ..... F25B 1/10 62/228.1
2011/0232308 A1* 9/2011 Morimoto ..... F25B 13/00 62/132
2012/0055185 A1* 3/2012 Luo ..... F25B 6/02 62/222
2012/0266616 A1* 10/2012 Lee ..... F25B 13/00 62/80
2013/0104576 A1* 5/2013 Lee ..... F25B 13/00 62/80
2013/0192284 A1 8/2013 Kawai et al.
2014/0116078 A1* 5/2014 Doumyou ..... F25B 13/00 62/238.6
2015/0159929 A1* 6/2015 Hancock ..... F25B 27/02 62/79
2015/0292756 A1* 10/2015 Takenaka ..... F25B 13/00 62/160
2015/0292789 A1* 10/2015 Takenaka ..... F25B 13/00 62/140
2016/0116202 A1* 4/2016 Takenaka ..... F25B 13/00 62/140
2016/0252290 A1* 9/2016 Ariyama ..... F25B 13/00 62/140
2016/0273817 A1* 9/2016 Makino ..... F25B 13/00
2016/0370045 A1* 12/2016 Takenaka ..... F25B 47/02
2017/0370627 A1* 12/2017 Takenaka ..... F24F 11/89

FOREIGN PATENT DOCUMENTS

JP 2008-25901 A 2/2008
JP 2008-25919 A 2/2008
JP 2008-209022 A 9/2008
JP 2013-155964 A 8/2013
JP 2014-126310 A 7/2014

OTHER PUBLICATIONS

International Search Report for PCT/JP2017/000648 dated Apr. 4, 2017.

* cited by examiner

REFRIGERATION APPARATUS FOR OIL AND DEFROST CONTROL

CROSS-REFERENCE TO RELATED APPLICATIONS

This application is a Continuation of PCT International Application No. PCT/JP2017/000648, filed on Jan. 11, 2017, which claims priority under 35 U.S.C. 119(a) to Patent Application No. 2016-005927, filed in Japan on Jan. 15, 2016, all of which are hereby expressly incorporated by reference into the present application.

TECHNICAL FIELD

The present invention relates to a refrigeration apparatus.

BACKGROUND ART

Conventionally, in an air conditioning apparatus in which a plurality of outdoor units are connected in parallel to an indoor unit, a defrost operation for removing frost adhering to outdoor heat exchangers of the outdoor units is performed.

For example, the air-conditioning apparatus disclosed in Patent Literature 1 (Japanese Laid-open Patent Publication No. 2008-25919) addresses the problem that when a reverse-cycle defrost is performed, in which all outdoor heat exchangers are caused to function as condensers and an indoor heat exchanger is caused to function as an evaporator, the temperature of the indoor heat exchanger decreases excessively during defrosting, and a long time is needed until warm air starts to be supplied when an air-warming operation is restarted. Examination has been given to performing defrosting of the outdoor heat exchangers by causing only some of the plurality of outdoor heat exchangers to function as condensers and rotating the outdoor heat exchangers that are caused to function as condensers.

SUMMARY OF THE INVENTION

Technical Problem

In this case, when the air-warming operation is being executed, not only does frost adhere to the outdoor heat exchangers, necessitating defrosting, but an operation to return refrigerator oil to a compressor also becomes necessary in order to prevent the refrigerator oil of the compressor from flowing out into a refrigerant circuit and the refrigerator oil in the compressor from becoming depleted.

However, when defrosting is performed while switching the outdoor heat exchangers to be defrosted rather than performing a reverse-cycle defrost, refrigerant flow between the outdoor units will be predominant, and it is therefore difficult to sufficiently return the refrigerator oil in the indoor heat exchanger and/or interconnection tubes to the compressor.

On the other hand, when a reverse-cycle defrost is performed, the outdoor heat exchangers become condensers, the indoor heat exchanger becomes an evaporator, and refrigerant flows sufficiently in the entire refrigerant circuit; therefore, refrigerator oil can be returned to the compressor, but the temperature decreases in the indoor heat exchanger functioning as an evaporator.

The present invention was devised in view of the matters described above, it being an object of the present invention to provide a refrigeration apparatus in which a decrease in a temperature of an indoor heat exchanger can be suppressed as much as possible while depletion of refrigerator oil in a compressor is also suppressed.

Solution to Problem

A refrigeration apparatus according to a first aspect is configured from a parallel connection of a plurality of outdoor units to an indoor unit, the refrigeration apparatus comprising a refrigerant circuit and a controller. The refrigerant circuit is configured from a connection of an indoor heat exchanger provided to the indoor unit, and outdoor heat exchangers, compressors, and switching valves provided to the respective outdoor units. The refrigerant circuit is capable of executing at least an air-warming operation. The controller includes at least one processor programmed to selectively execute either an alternating defrost mode or a reverse-cycle defrost mode when a predetermined defrosting condition is fulfilled during execution of the air-warming operation. In the alternating defrost mode, an operation, which is performed with the switching valves having been connected such that at least one of the outdoor heat exchangers of the plurality of outdoor units is caused to function as evaporator while one or more outdoor heat exchangers of the rest of the plurality of outdoor units is caused to function as condenser by being designated for defrosting, is executed while switching the outdoor heat exchanger to be defrosted. The reverse-cycle defrost mode is executed with the switching valves having been connected such that the outdoor heat exchangers of the outdoor units are caused to function as condensers and the indoor heat exchanger is caused to function as an evaporator. When the predetermined defrosting condition having been fulfilled, the at least one processor selectively executes the reverse-cycle defrost mode when a predetermined outflow condition pertaining to an outflow integrated quantity of refrigerator oil has also been fulfilled and selectively executes the alternating defrost mode when the predetermined outflow condition has not been fulfilled.

In this refrigeration apparatus, when the predetermined defrosting condition is fulfilled, frost adhering to at least one of the outdoor heat exchangers can be melted by executing either the alternating defrost mode or the reverse-cycle defrost mode.

Moreover, upon fulfillment of the predetermined defrosting condition, when a predetermined outflow condition pertaining to an outflow integrated quantity of refrigerator oil has not been fulfilled, the alternating defrost mode is preferentially executed rather than the reverse-cycle defrost mode. In the alternating defrost mode, at least one of the outdoor heat exchangers not to be defrosted is caused to function as refrigerant evaporator, whereby refrigerant evaporation occurring in the indoor heat exchanger can be better suppressed in comparison with the reverse defrost mode, in which only the indoor heat exchanger functions as a refrigerant evaporator. Therefore, in the alternating defrost mode, it is possible to suppress the temperature decrease in the indoor heat exchanger caused by refrigerant evaporating in the indoor heat exchanger. It is thereby possible to shorten the time needed until the alternating defrost mode ends and warm air starts to be supplied when the air-warming operation is restarted.

When the predetermined defrosting condition has been fulfilled and the predetermined outflow condition has also been fulfilled, not only is frost adhering to the outdoor heat exchangers melted, but a large amount of refrigerant flows to the indoor unit side in the refrigerant circuit due to the reverse defrost mode being executed, whereby the refrigerator oil flowing out to the indoor unit side in the refrigerant circuit can be returned to the compressor and the depletion of refrigerator oil in the compressor can be suppressed. Additionally, because execution of the reverse defrost mode is limited to when the predetermined defrosting condition has fulfilled and the predetermined outflow condition has also been fulfilled, it is also possible to reduce the frequency with which the temperature of the indoor heat exchanger decreases during defrosting.

Due to the configuration described above, it is possible to suppress the temperature decrease in the indoor heat exchanger as much as possible while also suppressing the depletion of refrigerator oil in the compressor.

A refrigeration apparatus according to a second aspect is the refrigeration apparatus according to the first aspect, wherein fulfillment of the predetermined outflow condition refers to: an instance in which, assuming that an operation in which the largest amount of oil flows out of the compressor is continually performed from a point in time when the predetermined defrosting condition is fulfilled, the time needed to reach a predetermined state of oil depletion is equal to or less than a predetermined time; and/or an instance in which, when an outflow integrated value of refrigerator oil determined when the predetermined defrosting condition has been fulfilled, the outflow integrated value being established on the basis of a rotational speed of the compressor and a high pressure and a low pressure of the refrigerant circuit, is equal to or greater than a predetermined integrated value.

In this refrigeration apparatus, execution of the reverse defrost mode is limited to cases in which the predetermined defrosting condition is fulfilled and the above-described predetermined outflow condition has also been fulfilled, and also to circumstances in which a large amount of refrigerator oil flows out of the compressor. Therefore, the reverse defrost mode is executed only in circumstances in which a large amount of refrigerator oil flows out of the compressor and defrosting is performed by the alternating defrost mode in all other cases, and it is therefore possible to more reliably reduce the frequency with which the temperature of the indoor heat exchanger decreases during defrosting.

A refrigeration apparatus according to a third aspect is the refrigeration apparatus according to the first or second aspect, wherein the at least one processor is further programmed to determine whether the predetermined outflow condition is fulfilled or not by using the outflow integrated value of the refrigerator oil, resets the outflow integrated value when the reverse-cycle defrost mode has been executed, and starts integration anew.

In this refrigeration apparatus, when the reverse defrost mode has been executed, it is possible to not only melt the frost adhering to the outdoor heat exchangers, but also to return the refrigerator oil flowing out to the indoor unit side in the refrigerant circuit to the compressor. When the reverse defrost mode has been executed, the outflow integrated value of refrigerator oil is reset and integration can be started anew. Therefore, it is possible to make the outflow integrated value of refrigerator oil after execution of the reverse defrost mode to correspond to the current state of the refrigerant circuit.

EFFECTS OF THE INVENTION

With the refrigeration apparatus according to the first aspect, it is possible to suppress the temperature decrease in the indoor heat exchanger as much as possible while also suppressing the depletion of refrigerator oil in the compressor.

With the refrigeration apparatus according to the second aspect, it is possible to more reliably reduce the frequency with which the temperature of the indoor heat exchanger decreases during defrosting.

With the refrigeration apparatus according to the third aspect, it is possible to make the outflow integrated value of refrigerator oil after execution of the reverse defrost mode to correspond to the current state of the refrigerant circuit.

DESCRIPTION OF EMBODIMENTS

Below is a description, made with reference to the drawings, of an embodiment in which the refrigeration apparatus of the present invention is employed.

(1) Overall general configuration

Figure 1:
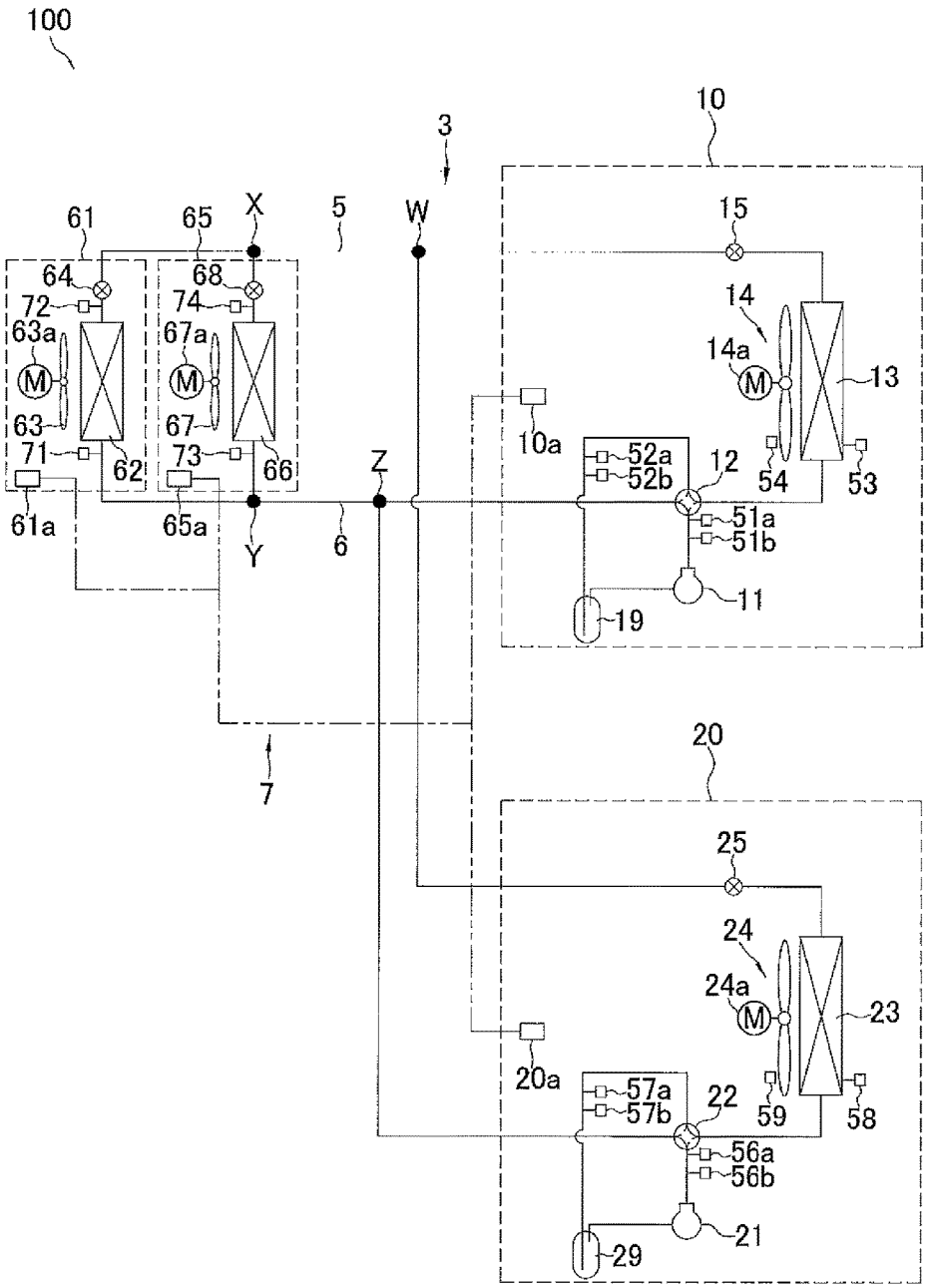
FIG. 1 is a refrigerant circuit diagram of an air-conditioning apparatus.
Figure 2:
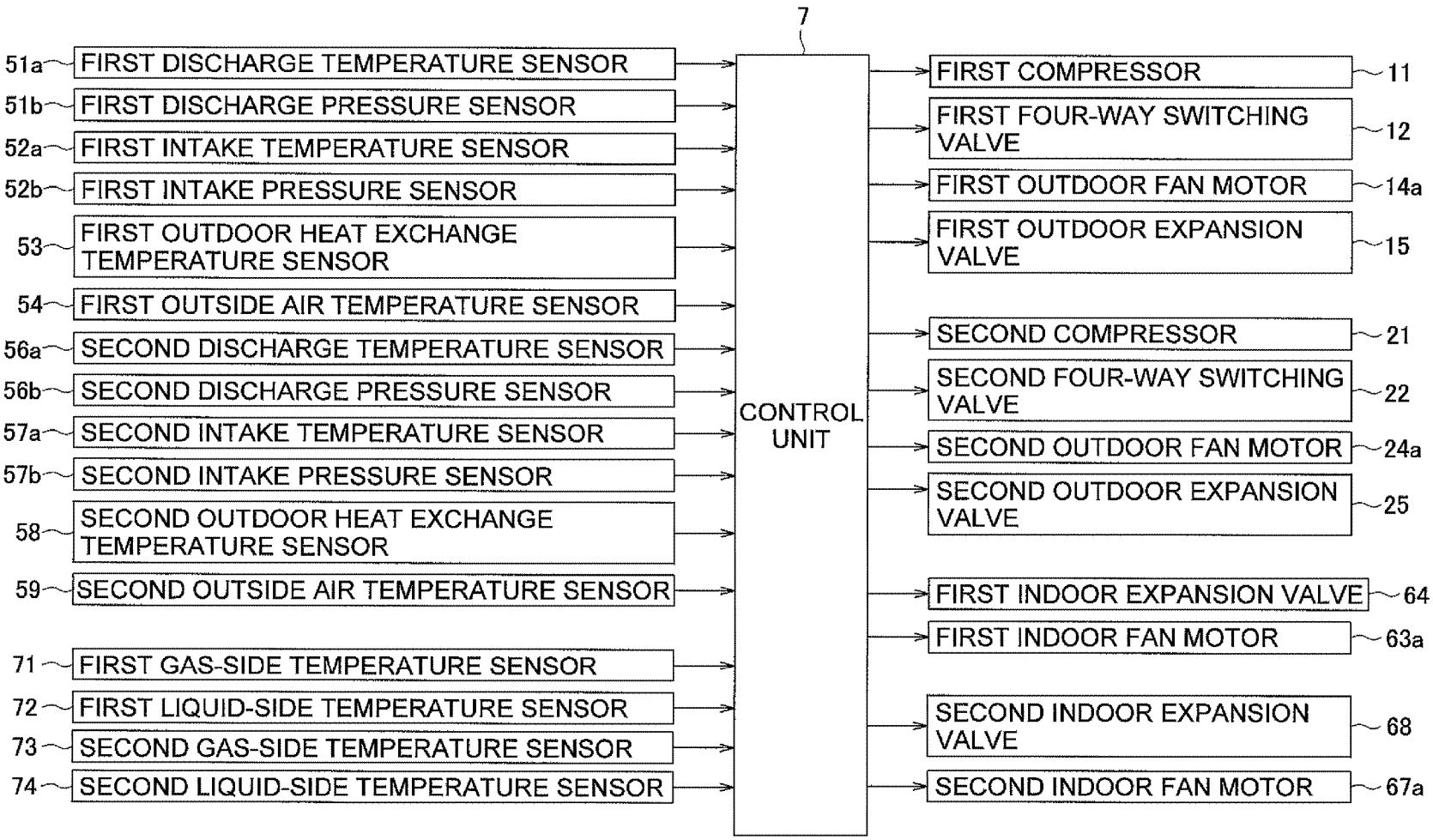
FIG. 2 is a block configuration diagram of the air-conditioning apparatus.

FIG. 1 shows a refrigerant circuit diagram of an air-conditioning apparatus 100. FIG. 2 shows a block configuration diagram of the air-conditioning apparatus 100.

The air-conditioning apparatus 100 of the present embodiment is provided with a first outdoor unit 10, a second outdoor unit 20, a first indoor unit 61, and a second indoor unit 65.

The first outdoor unit 10, the second outdoor unit 20, the first indoor unit 61, and the second indoor unit 65 configure a refrigerant circuit 3 by being connected to each other via a liquid-side refrigerant interconnection tube 5 and a gas-side refrigerant interconnection tube 6. In the refrigerant circuit 3 of the present embodiment, the first indoor unit 61 and the second indoor unit 65 are connected in parallel to the first outdoor unit 10 and the second outdoor unit 20 via the liquid-side refrigerant interconnection tube 5 and the gas-side refrigerant interconnection tube 6. Additionally, the first outdoor unit 10 and the second outdoor unit 20 are connected in parallel to the first indoor unit 61 and the second indoor unit 65 via the liquid-side refrigerant interconnection tube 5 and the gas-side refrigerant interconnection tube 6.

Working refrigerant is sealed within the refrigerant circuit 3 so that a refrigeration cycle can be carried out.

The air-conditioning apparatus 100 is operably controlled and/or monitored by a control unit (or controller) 7. In this embodiment, a first indoor-side control board 61*a* provided to the first indoor unit 61, a second indoor-side control board 65*a* provided to the second indoor unit 65, a first outdoor-side control board 10*a* provided to the first outdoor unit 10, and a second outdoor-side control board 20*a* provided to the second outdoor unit 20 are connected so as to be capable of intercommunicating, thereby configuring the control unit 7.

(2) First indoor unit 61

The first indoor unit 61 has a first indoor heat exchanger 62, a first indoor expansion valve 64, a first indoor fan 63, a first indoor fan motor 63*a*, a first gas-side temperature sensor 71, and a first liquid-side temperature sensor 72.

The first indoor heat exchanger 62 configures part of the refrigerant circuit 3. A gas-side end of the first indoor heat exchanger 62 is connected with a refrigerant tube extending from a point Y, which is an end of the gas-side refrigerant interconnection tube 6 to be described hereinafter. A liquid-side end of the first indoor heat exchanger 62 is connected with a refrigerant tube extending from a point X, which is an end of the liquid-side refrigerant interconnection tube 5 to be described hereinafter.

The first indoor expansion valve 64 is provided to the liquid side of the first indoor heat exchanger 62 (specifically, midway through the refrigerant tube joining point X and the liquid-side end of the first indoor heat exchanger 62) within the refrigerant circuit 3. There are no particular limitations as to the first indoor expansion valve 64; for example, the valve can be an electric expansion valve of which the valve opening degree can be adjusted in order to adjust the amount and/or degree of decompression of the refrigerant flowing therethrough.

The first indoor fan 63 forms an air flow that sends air in a space to be air-conditioned (indoors) to the first indoor heat exchanger 62 and returns air that has passed through the first indoor heat exchanger 62 back to the space to be air-conditioned. The airflow volume of the first indoor fan 63 is adjusted due to the first indoor fan motor 63*a* being drivably controlled.

The first gas-side temperature sensor 71, which is attached to a refrigerant tube between point Y of the gas-side refrigerant interconnection tube 6 and a gas side of the first indoor heat exchanger 62, senses the temperature of the refrigerant passing through the gas-side end of the first indoor heat exchanger 62.

The first liquid-side temperature sensor 72, which is attached to a refrigerant tube between the first indoor expansion valve 64 and the liquid side of the first indoor heat exchanger 62, senses the temperature of the refrigerant passing through a liquid-side end of the first indoor heat exchanger 62.

The first indoor-side control board 61*a*, which configures part of the control unit 7 described above, is provided to the first indoor unit 61. The first indoor-side control board 61*a*, which is configured having a CPU, a ROM, a RAM, etc., controls the valve opening degree of the first indoor expansion valve 64, controls the airflow volume of the first indoor fan 63 via the first indoor fan motor 63*a*, ascertains the temperature sensed by the first gas-side temperature sensor 71, ascertains the temperature sensed by the first liquid-side temperature sensor 72, etc.

(3) Second indoor unit 65

The second indoor unit 65, which is similar to the first indoor unit 61, has a second indoor heat exchanger 66, a second indoor expansion valve 68, a second indoor fan 67, a second indoor fan motor 67*a*, a second gas-side temperature sensor 73, and a second liquid-side temperature sensor 74.

The second indoor heat exchanger 66 configures part of the refrigerant circuit 3. A gas-side end of the second indoor heat exchanger 66 is connected with a refrigerant tube (separate from the refrigerant tube extending to the first indoor heat exchanger 62) extending from point Y, which is the end of the gas-side refrigerant interconnection tube 6 to be described hereinafter. A liquid-side end of the second indoor heat exchanger 66 is connected with a refrigerant tube (separate from the refrigerant tube extending to the first indoor heat exchanger 62) extending from point X, which is the end of the liquid-side refrigerant interconnection tube 5 to be described hereinafter.

The second indoor expansion valve 68 is provided to the liquid side of the second indoor heat exchanger 66 (specifically, midway through the refrigerant tube joining point X and the liquid-side end of the second indoor heat exchanger 66) within the refrigerant circuit 3. There are no particular limitations as to the second indoor expansion valve 68; for example, the valve can be an electric expansion valve of which the valve opening degree can be adjusted in order to adjust the amount and/or degree of decompression of the refrigerant flowing therethrough, in the same manner as the first indoor expansion valve 64.

The second indoor fan 67 forms an air flow that sends air in a space to be air-conditioned (indoors) to the second indoor heat exchanger 66 and returns air that has passed through the second indoor heat exchanger 66 back to the space to be air-conditioned. The airflow volume of the second indoor fan 67 is adjusted due to the second indoor fan motor 67*a* being drivably controlled.

The second gas-side temperature sensor 73, which is attached to a refrigerant tube between point Y of the gas-side refrigerant interconnection tube 6 and a gas side of the second indoor heat exchanger 66, senses the temperature of the refrigerant passing through the gas-side end of the second indoor heat exchanger 66.

The second liquid-side temperature sensor 74, which is attached to a refrigerant tube between the second indoor expansion valve 68 and the liquid side of the second indoor heat exchanger 66, senses the temperature of the refrigerant passing through a liquid-side end of the second indoor heat exchanger 66.

The second indoor-side control board 65*a*, which configures part of the control unit 7 described above, is provided to the second indoor unit 65. The second indoor-side control board 65*a*, which is configured having a CPU, a ROM, a RAM, etc., controls the valve opening degree of the second indoor expansion valve 68, controls the airflow volume of the second indoor fan 67 via the second indoor fan motor 67*a*, ascertains the temperature sensed by the second gas-side temperature sensor 73, ascertains the temperature sensed by the second liquid-side temperature sensor 74, etc.

(4) First outdoor unit 10

The first outdoor unit 10 has a first compressor 11, a first four-way switching valve 12, a first outdoor heat exchanger 13, a first outdoor fan 14, a first outdoor fan motor 14*a*, a first outdoor expansion valve 15, a first accumulator 19, a first discharge temperature sensor 51*a*, a first discharge pressure sensor 51*b*, a first intake temperature sensor 52*a*, a first intake pressure sensor 52*b*, a first outdoor heat exchange temperature sensor 53, and a first outside air temperature sensor 54.

The first compressor 11 is a compressor of which the frequency can be controlled and the operating capacity can be varied.

The first four-way switching valve 12 has four connection ports, of which two are connected to each other and the other two are connected to each other. The first outdoor unit 10 can be switched between an air-cooling operation state and an air-warming operation state by switching the connection state of the first four-way switching valve 12. In the air-cooling operation state of the first outdoor unit 10, the first four-way switching valve 12 is switched so that an intake side of the first compressor 11 connects to the gas-side refrigerant interconnection tube 6 and the refrigerant discharged from the first compressor 11 is channeled to the first outdoor heat exchanger 13. In the air-warming operation state of the first outdoor unit 10, the first four-way switching valve 12 is switched so that the intake side of the first compressor 11 connects to the first outdoor heat exchanger 13 and the refrigerant discharged from the first compressor 11 is channeled to the gas-side refrigerant interconnection tube 6.

The first outdoor heat exchanger 13 can function as a refrigerant heat radiator (condenser) when the first outdoor unit 10 is in the air-cooling operation state and can function as a refrigerant evaporator when the first outdoor unit 10 is in the air-warming operation state. There are no particular limitations as to the first outdoor heat exchanger 13; for example, this heat exchanger is configured from a plurality of heat transfer fins and heat transfer tubes.

The first outdoor fan 14 rotates due to the driving of the first outdoor fan motor 14*a* and supplies outdoor air to the first outdoor heat exchanger 13.

The first outdoor expansion valve 15 is provided to a liquid side of the first outdoor heat exchanger 13 (between the liquid side of the first outdoor heat exchanger 13 and the liquid-side refrigerant interconnection tube 5). There are no particular limitations as to the first outdoor expansion valve 15; for example, the valve can be an electric expansion valve of which the amount and/or degree of decompression of the refrigerant flowing therethrough can be adjusted.

The first accumulator 19 is a refrigerant container provided between one connection port of the first four-way switching valve 12 and the intake side of the first compressor 11.

The first discharge temperature sensor 51*a* senses the temperature of the refrigerant flowing between a discharge side of the first compressor 11 and one connection port of the first four-way switching valve 12.

The first discharge pressure sensor 51*b* senses the pressure of the refrigerant flowing between the discharge side of the first compressor 11 and one connection port of the first four-way switching valve 12.

The first intake temperature sensor 52*a* senses the temperature of the refrigerant flowing between the intake side of the first compressor 11 and one connection port of the first four-way switching valve 12.

The first intake pressure sensor 52*b* senses the pressure of the refrigerant flowing between the intake side of the first compressor 11 and one connection port of the first four-way switching valve 12.

The first outdoor heat exchange temperature sensor 53 senses the temperature of the refrigerant flowing through the first outdoor heat exchanger 13.

The first outside air temperature sensor 54 senses the temperature of outdoor air, before the outdoor air passes through the first outdoor heat exchanger 13, as an outside air temperature.

The first outdoor-side control board 10*a*, which configures part of the control unit 7 described above, is provided to the first outdoor unit 10. The first outdoor-side control board 10*a*, which is configured having a CPU, a ROM, a RAM, etc., controls the drive frequency of the first compressor 11, switches the connection state of the first four-way switching valve 12, controls the airflow volume of the first outdoor fan 14 via the first outdoor fan motor 14*a*, controls the valve opening degree of the first outdoor expansion valve 15, ascertains the temperature sensed by the first discharge temperature sensor 51*a*, ascertains the temperature sensed by the first discharge pressure sensor 51*b*, ascertains the temperature sensed by the first intake temperature sensor 52*a*, ascertains the temperature sensed by the first intake pressure sensor 52*b*, ascertains the temperature sensed by the first outdoor heat exchange temperature sensor 53, ascertains the temperature sensed by the first outside air temperature sensor 54, etc.

(5) Second outdoor unit 20

The second outdoor unit 20 is configured in a manner similar to the first outdoor unit 10, as is described below.

The second outdoor unit 20 has a second compressor 21, a second four-way switching valve 22, a second outdoor heat exchanger 23, a second outdoor fan 24, a second outdoor fan motor 24*a*, a second outdoor expansion valve 25, a second accumulator 29, a second discharge temperature sensor 56*a*, a second discharge pressure sensor 56*b*, a second intake temperature sensor 57*a*, a second intake pressure sensor 57*b*, a second outdoor heat exchange temperature sensor 58, and a second outside air temperature sensor 59.

The second compressor 21 is a compressor of which the frequency can be controlled and the operating capacity can be varied.

The second four-way switching valve 22 has four connection ports, of which two are connected to each other and the other two are connected to each other. The second outdoor unit 20 can be switched between an air-cooling operation state and an air-warming operation state by switching the connection state of the second four-way switching valve 22. In the air-cooling operation state of the second outdoor unit 20, the second four-way switching valve 22 is switched so that an intake side of the second compressor 21 connects to the gas-side refrigerant interconnection tube 6 and the refrigerant discharged from the second compressor 21 is channeled to the second outdoor heat exchanger 23. In the air-warming operation state of the second outdoor unit 20, the second four-way switching valve 22 is switched so that the intake side of the second compressor 21 connects to the second outdoor heat exchanger 23 and the refrigerant discharged from the second compressor 21 is channeled to the gas-side refrigerant interconnection tube 6.

The second outdoor heat exchanger 23 can function as a refrigerant heat radiator (condenser) when the second outdoor unit 20 is in the air-cooling operation state and can function as a refrigerant evaporator when the second outdoor unit 20 is in the air-warming operation state. There are no particular limitations as to the second outdoor heat exchanger 23; for example, this heat exchanger is configured from a plurality of heat transfer fins and heat transfer tubes.

The second outdoor fan 24 rotates due to the driving of the second outdoor fan motor 24*a* and supplies outdoor air to the second outdoor heat exchanger 23.

The second outdoor expansion valve 25 is provided to a liquid side of the second outdoor heat exchanger 23 (between the liquid side of the second outdoor heat exchanger 23 and the liquid-side refrigerant interconnection tube 5). There are no particular limitations as to the second outdoor expansion valve 25; for example, the valve can be an electric expansion valve of which the amount and/or degree of decompression of the refrigerant flowing therethrough can be adjusted.

The second accumulator 29 is a refrigerant container provided between one connection port of the second four-way switching valve 22 and the intake side of the second compressor 21.

The second discharge temperature sensor 56*a* senses the temperature of the refrigerant flowing between a discharge side of the second compressor 21 and one connection port of the second four-way switching valve 22.

The second discharge pressure sensor 56*b* senses the pressure of the refrigerant flowing between the discharge side of the second compressor 21 and one connection port of the second four-way switching valve 22.

The second intake temperature sensor 57*a* senses the temperature of the refrigerant flowing between the intake side of the second compressor 21 and one connection port of the second four-way switching valve 22.

The second intake pressure sensor 57*b* senses the pressure of the refrigerant flowing between the intake side of the second compressor 21 and one connection port of the second four-way switching valve 22.

The second outdoor heat exchange temperature sensor 58 senses the temperature of the refrigerant flowing through the second outdoor heat exchanger 23.

The second outside air temperature sensor 59 senses the temperature of outdoor air, before the outdoor air passes through the second outdoor heat exchanger 23, as the outside air temperature.

The second outdoor-side control board 20*a,* which configures part of the control unit 7 described above, is provided to the second outdoor unit 20. The second outdoor-side control board 20*a,* which is configured having a CPU, a ROM, a RAM, etc., controls the drive frequency of the second compressor 21, switches the connection state of the second four-way switching valve 22, controls the airflow volume of the second outdoor fan 24 via the second outdoor fan motor 24*a,* controls the valve opening degree of the second outdoor expansion valve 25, ascertains the temperature sensed by the second discharge temperature sensor 56*a,* ascertains the temperature sensed by the second discharge pressure sensor 56*b*, ascertains the temperature sensed by the second intake temperature sensor 57*a,* ascertains the temperature sensed by the second intake pressure sensor 57*b,* ascertains the temperature sensed by the second outdoor heat exchange temperature sensor 58, ascertains the temperature sensed by the second outside air temperature sensor 59, etc.

(6) Liquid-side refrigerant interconnection tube 5 and gas-side refrigerant interconnection tube 6

The liquid-side refrigerant interconnection tube 5 and the gas-side refrigerant interconnection tube 6 connect the first indoor unit 61 and the second indoor unit 65 with the first outdoor unit 10 and the second outdoor unit 20.

The liquid-side refrigerant interconnection tube 5 connects point X, which is a merging point of a tube extending from the first indoor expansion valve 64 of the first indoor unit 61 to the liquid side and a tube extending from the second indoor expansion valve 68 of the second indoor unit 65 to the liquid side, and point W, which is a merging point of a tube extending from the first outdoor expansion valve 15 of the first outdoor unit 10 to the liquid side and a tube extending from the second outdoor expansion valve 25 of the second outdoor unit 20 to the liquid side. The liquid-side refrigerant interconnection tube 5 configures part of the refrigerant circuit 3.

The gas-side refrigerant interconnection tube 6 connects point Y, which is a merging point of a tube extending from the first indoor heat exchanger 62 of the first indoor unit 61 to the gas side and a tube extending from the second indoor heat exchanger 66 of the second indoor unit 65 to the gas side, and point Z, which is a merging point of a tube extending from one connection port of the first four-way switching valve 12 of the first outdoor unit 10 to the gas side and a tube extending from one connection port of the second four-way switching valve 22 of the second outdoor unit 20 to the gas side. The gas-side refrigerant interconnection tube 6 configures part of the refrigerant circuit 3.

The liquid-side refrigerant interconnection tube 5 and the gas-side refrigerant interconnection tube 6 extend from positions where the first outdoor unit 10 and the second outdoor unit 20 are installed to positions where the first indoor unit 61 and the second indoor unit 65 are installed, and these refrigerant interconnection tubes are the longest of the tubes configuring the refrigerant circuit 3.

(7) Air-cooling operation state

In the air-cooling operation state, the control unit 7 switches the connection states of the first four-way switching valve 12 and the second four-way switching valve 22 and executes a refrigeration cycle (refer to the connection states indicated by the dotted lines in the first four-way switching valve 12 and the second four-way switching valve 22 in FIG. 1) so that the first indoor heat exchanger 62 and the second indoor heat exchanger 66 function as refrigerant evaporators and the first outdoor heat exchanger 13 and the second outdoor heat exchanger 23 function as refrigerant heat radiators (condensers). Specifically, the control unit 7 performs a refrigeration cycle in which the connection state of the first four-way switching valve 12 causes the refrigerant discharged from the first compressor 11 to be channeled to the first outdoor heat exchanger 13 and some of the refrigerant flowing from the gas sides of the first indoor unit 61 and the second indoor unit 65 to be channeled to the intake side of the first compressor 11, and the connection state of the second four-way switching valve 22 causes the refrigerant discharged from the second compressor 21 to be channeled to the second outdoor heat exchanger 23 and the rest of the refrigerant flowing from the gas sides of the first indoor unit 61 and the second indoor unit 65 to be channeled to the intake side of the second compressor 21.

In the air-cooling operation state, the control unit 7 controls the first outdoor expansion valve 15 and the second outdoor expansion valve 25 so that both are fully open. The control unit 7 then performs control on the valve opening degrees of the first indoor expansion valve 64 and the second indoor expansion valve 68 so that the degree of superheating of the refrigerant flowing through the gas sides of the first indoor heat exchanger 62 and the second indoor heat exchanger 66 reaches a target degree of superheating.

The drive frequencies of the first compressor 11 and second compressor 21, the first indoor fan motor 63*a* and second indoor fan motor 67*a,* and/or the first outdoor fan motor 14*a* and second outdoor fan motor 24*a* are controlled their driving by the control unit 7 in order to satisfy respective predetermined control conditions.

(8) Air-warming operation state

In the air-warming operation state, the control unit 7 switches the connection states of the first four-way switching valve 12 and the second four-way switching valve 22 and executes a refrigeration cycle (refer to the connection states indicated by the solid lines in the first four-way switching valve 12 and the second four-way switching valve 22 in FIG. 1) so that the first outdoor heat exchanger 13 and the second outdoor heat exchanger 23 function as refrigerant evaporators and the first indoor heat exchanger 62 and the second indoor heat exchanger 66 function as refrigerant heat radiators (condensers). Specifically, the control unit 7 performs a refrigeration cycle that causes the connection state of the first four-way switching valve 12 to be one in which the refrigerant flowing from the first outdoor heat exchanger 13 is channeled to the intake side of the first compressor 11 while the refrigerant discharged from the first compressor 11 becomes some of the refrigerant sent to the gas sides of the first indoor unit 61 and the second indoor unit 65, and the connection state of the second four-way switching valve 22 to be one in which the refrigerant flowing from the second outdoor heat exchanger 23 is channeled to the intake side of the second compressor 21 while the refrigerant discharged from the second compressor 21 becomes the rest of the refrigerant sent to the gas sides of the first indoor unit 61 and the second indoor unit 65.

In the air-warming operation state, the control unit 7 performs control on the valve opening degrees of the first indoor expansion valve 64 and the second indoor expansion valve 68 so that the degree of supercooling of the refrigerant flowing through the liquid sides of the first indoor heat exchanger 62 and the second indoor heat exchanger 66 reaches a target degree of supercooling. The control unit 7 also performs control on the valve opening degrees of the first outdoor expansion valve 15 and the second outdoor expansion valve 25 so that the refrigerant sent to the first outdoor heat exchanger 13 and/or the second outdoor heat exchanger 23 can be decompressed.

The drive frequencies of the first compressor 11 and second compressor 21, the first indoor fan motor 63*a* and second indoor fan motor 67*a*, and/or the first outdoor fan motor 14*a* and second outdoor fan motor 24*a* are controlled their driving by the control unit 7 in order to satisfy respective predetermined control conditions.

(9) Oil return operation

The control unit 7 performs an oil return operation when a predetermined oil return condition has been fulfilled.

The oil return operation is performed when the predetermined oil return condition has been fulfilled (started by the fulfilling of the predetermined oil return condition), and is differentiated from an alternating defrost mode and/or a reverse-cycle defrost mode performed when a predetermined defrosting condition, described hereinafter, is fulfilled (started by the fulfilling of the predetermined defrosting condition).

Specifically, when the integrated operation time of the first compressor 11 or the second compressor 21 exceeds a predetermined time, the predetermined oil return condition is determined to have been met and the oil return operation is performed. Furthermore, the predetermined oil return condition is determined to have been met and the oil return operation is performed also when an outflow integrated value of refrigerator oil for the first compressor 11 or the second compressor 21 exceeds a predetermined integrated value for oil return.

The control unit 7 determines whether or not the count of the integrated operation time and/or the integrated operation time of the first compressor 11 or second compressor 21 exceeds a predetermined time. Additionally, the control unit 7 also performs the determination of whether or not the count of the outflow integrated value and/or the outflow integrated value of the first compressor 11 or second compressor 21 exceeds the predetermined integrated value for oil return. There are no particular limitations as to the method of counting the outflow integrated value of the refrigerator oil; for example, a value calculated using the rotational speed of the compressor of interest, the low pressure on the intake side, and the high pressure on the discharge side can be used (the same applies in the determination of a predetermined outflow condition, described hereinafter). The integrated operation time of the first compressor 11 and second compressor 21 and/or the outflow integrated value of the refrigerator oil are reset when the oil return operation is performed and when the reverse-cycle defrost mode, described hereinafter, is executed, and the count begins again from zero.

Figure 3:
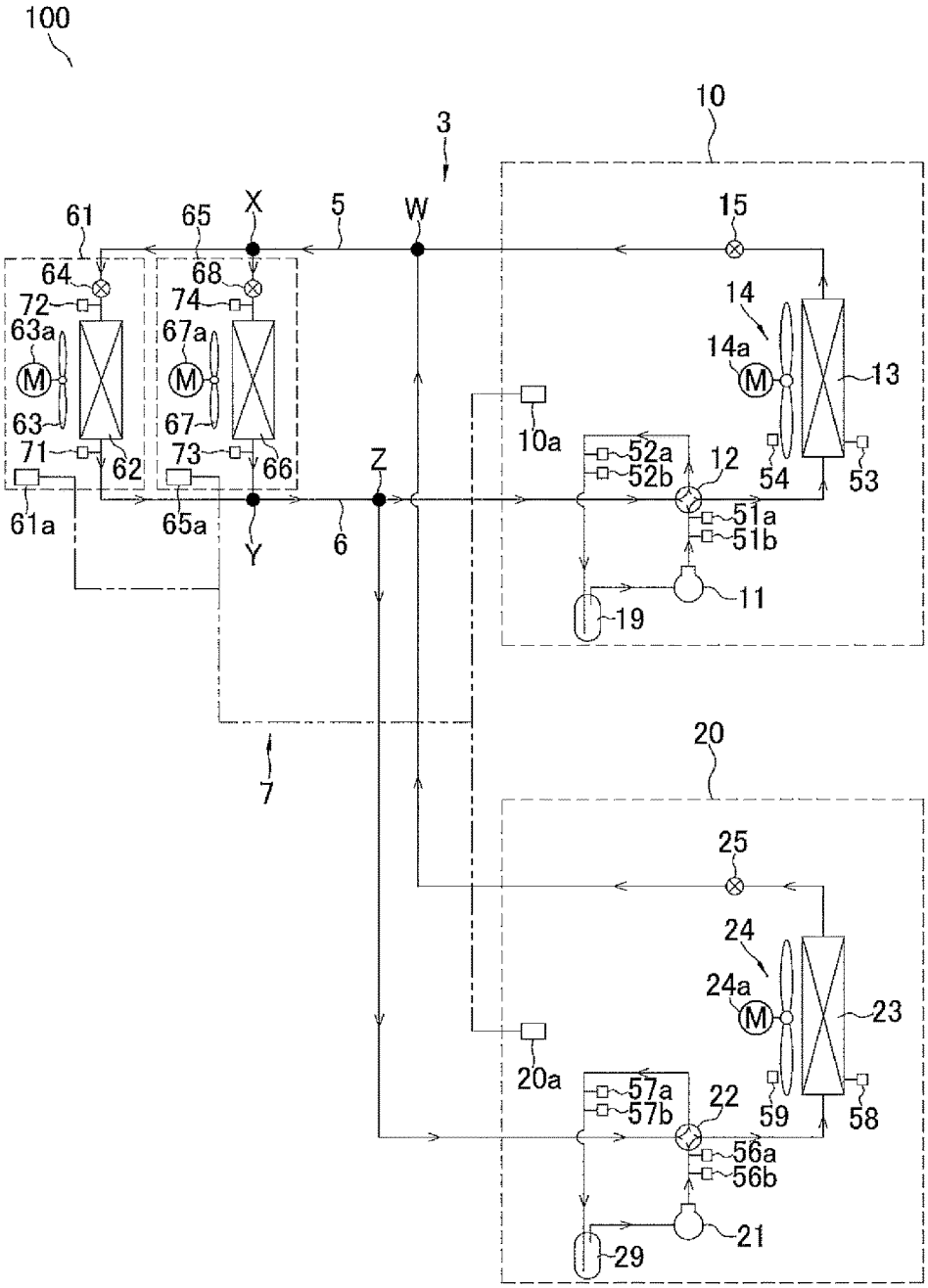
FIG. 3 shows how refrigerant flows during the oil return operation and during execution of the reverse-cycle defrost mode.

As shown in FIG. 3, in the oil return operation, the connection state of the first four-way switching valve 12 is switched so that the refrigerant passing through the portion of point Z of the refrigerant circuit 3 is channeled to the intake side of the first compressor 11 and the refrigerant discharged from the first compressor 11 is sent to the first outdoor heat exchanger 13, and the connection state of the second four-way switching valve 22 is switched so that the refrigerant passing through the portion of point Z of the refrigerant circuit 3 is channeled to the intake side of the second compressor 21 and the refrigerant discharged from the second compressor 21 is sent to the second outdoor heat exchanger 23.

In this embodiment, the first outdoor expansion valve 15 and the second outdoor expansion valve 25 are both controlled by the control unit 7 so that the valve opening degrees reach the fully open state.

The first indoor expansion valve 64 and the second indoor expansion valve 68 are controlled so that the degree of superheating of the refrigerant taken into the first compressor 11 or the second compressor 21 reaches a predetermined degree of superheating. These refrigerant degrees of superheating are found from the temperature sensed by the first intake temperature sensor 52*a* and the pressure sensed by the first intake pressure sensor 52*b*, and/or the temperature sensed by the second intake temperature sensor 57*a* and the pressure sensed by the second intake pressure sensor 57*b*.

The first indoor fan motor 63*a* and/or the second indoor fan motor 67*a* is basically stopped so that cold air in the first indoor heat exchanger 62 and/or the second indoor heat exchanger 66 functioning as an evaporator is not sent into the room.

In the oil return operation described above, the refrigerant sent to point X of the refrigerant circuit 3 branches to flow toward the first indoor unit 61 and the second indoor unit 65. The refrigerant decompressed to a low pressure in the first indoor expansion valve 64 evaporates in the first indoor heat exchanger 62 functioning as a low-pressure refrigerant evaporator, and the refrigerant decompressed to a low pressure in the second indoor expansion valve 68 evaporates in the second indoor heat exchanger 66 functioning as a low-pressure refrigerant evaporator. The refrigerant flowing out from the first indoor heat exchanger 62 and the second indoor heat exchanger 66 merges at point Y of the refrigerant circuit 3, and the merged refrigerant is sent through the gas-side refrigerant interconnection tube 6 to point Z of the refrigerant circuit 3.

The refrigerant sent to point Z of the refrigerant circuit 3 branches to flow toward the first outdoor unit 10 and the second outdoor unit 20. The refrigerant sent to the first outdoor unit 10 is taken into the first compressor 11 via the first four-way switching valve 12 and the first accumulator 19. The refrigerant compressed to a high pressure in the first compressor 11 radiates heat in the first outdoor heat exchanger 13 and passes through the first outdoor expansion valve 15 to be sent to point W of the refrigerant circuit 3. Similarly, the refrigerant sent to the second outdoor unit 20 is taken into the second compressor 21 via the second four-way switching valve 22 and the second accumulator 29. The refrigerant compressed to a high pressure in the second compressor 21 radiates heat in the second outdoor heat exchanger 23 and passes through the second outdoor expansion valve 25 to be sent to point W of the refrigerant circuit 3. The refrigerant that has flowed here from the first outdoor unit 10 and the second outdoor unit 20 merges at point W of the refrigerant circuit 3, and the merged refrigerant is again sent to point X of the refrigerant circuit 3 via the liquid-side refrigerant interconnection tube 5.

In the oil return operation, the refrigerant circulating in the refrigerant circuit 3 flows through the liquid-side refrigerant interconnection tube 5 and the gas-side refrigerant interconnection tube 6 and flows through either the first indoor unit 61 or the second indoor unit 65; therefore, the refrigerator oil flowing out of the first outdoor unit 10 and/or the second outdoor unit 20 can be returned together with the refrigerant to the first compressor 11 and/or the second compressor 21, and it is possible to avoid situations in which the refrigerator oil is depleted.

When the control unit 7 determines that the predetermined oil return ending condition has been fulfilled during the oil return operation, the control unit 7 ends the oil return operation, switches the connection state of the first four-way switching valve 12 and/or the second four-way switching valve 22, and restarts the air-warming operation or air-cooling operation that was being performed before the oil return ending operation was started. In this embodiment, there are no particular limitations as to the predetermined oil return condition; for example, the condition may be fulfilled when a predetermined time has elapsed since the start of the oil return operation, or when the rotational speed of the first compressor 11 or the second compressor 21 reaches a predetermined speed.

(10) Defrost operation

The control unit 7 performs the defrost operation when the control unit 7 determines that the predetermined defrosting condition has been fulfilled while the above-described air-warming operation is being performed.

There are no particular limitations as to the predetermined defrosting condition; for example, the condition can be that the outside air temperature and the temperature of outdoor heat exchangers continue to meet a predetermined temperature condition for at least a predetermined time. In this case, the control unit 7 may ascertain the outside air temperature according to the temperature sensed by the first outside air temperature sensor 54 or the second outside air temperature sensor 59. Additionally, the control unit 7 may ascertain the temperature of the outdoor heat exchangers according to the temperature sensed by the first outdoor heat exchange temperature sensor 53 or the second outdoor heat exchange temperature sensor 58. In the present embodiment, the control unit 7 is configured so as to cause all outdoor heat exchangers to defrost when the predetermined defrosting condition is fulfilled for at least one of the first outdoor heat exchanger 13 and the second outdoor heat exchanger 23.

In the defrost operation, at the point in time when the predetermined defrosting condition is fulfilled, the alternating defrost mode is selected and executed when the predetermined outflow condition pertaining to an outflow integrated quantity of the refrigerator oil has not been fulfilled, and the reverse-cycle defrost mode is selected and executed when the predetermined outflow condition has been fulfilled.

(10-1) Predetermined outflow condition

There are no particular limitations as to the predetermined outflow condition; this condition may pertain to the outflow integrated quantity of the refrigerator oil from the compressor, or the condition may be determined by directly calculating the outflow integrated quantity or determined using a parameter associated with the outflow integrated quantity.

In the present embodiment, the control unit 7 determines that the predetermined outflow condition is fulfilled when any of the following (A), (B), or (C) are met.

(A) When it is presumed that a predetermined operation, during which the first compressor 11 and the second compressor 21 respectively discharge the largest amounts of oil, is continued from the point in time when the predetermined defrosting condition was fulfilled, and then when the time needed for a predetermined state of oil depletion to be reached from the point in time when the predetermined defrosting condition was fulfilled (the time needed for at least one of the first compressor 11 and the second compressor 21 to reach a predetermined state of oil depletion) is a predetermined time or less (e.g., 40 minutes or less), the control unit 7 of the present embodiment determines that the predetermined outflow condition is fulfilled.

In this embodiment, there are no particular limitations as to the predetermined operation in which the first compressor 11 and the second compressor 21 discharge the largest amounts of oil; for example, this operation can be performed at the maximum rotational speed stipulated for the first compressor 11 and the second compressor 21. Additionally, there are no particular limitations as to the predetermined state of oil depletion; in the present embodiment, this is a state of oil depletion to an extent that the above-described predetermined oil return condition is fulfilled (a state in which the outflow integrated value of refrigerator oil for the first compressor 11 or the second compressor 21 exceeds a predetermined integrated value for oil return). When it is presumed that the predetermined operation during which the first compressor 11 and the second compressor 21 respectively discharge the largest amounts of oil is continued from the point in time when the predetermined defrosting condition was fulfilled, the time needed to reach the predetermined state of oil depletion from the point in time when the predetermined defrosting condition was fulfilled is calculated by the control unit 7 on the basis of the outflow integrated quantities of refrigerator oil for the compressors at the point in time when the predetermined defrosting condition was fulfilled, and the control unit 7 also determines whether or not the elapsed time is equal to or less than the predetermined time.

(B) The control unit 7 of the present embodiment determines that the predetermined outflow condition is fulfilled also when the outflow integrated value of refrigerator oil at the fulfillment of the predetermined defrosting condition is equal to or greater than a predetermined integrated value. Specifically, the control unit 7 counts the outflow integrated value of refrigerator oil for both the first compressor 11 and the second compressor 21, and the control unit 7 determines that the predetermined outflow condition is fulfilled when at least one of the outflow integrated value of refrigerator oil for the first compressor 11 and the outflow integrated value of refrigerator oil for the second compressor 21 at the fulfillment of the predetermined defrosting condition is equal to or greater than the predetermined integrated value.

The outflow integrated quantity of refrigerator oil in (A) and (B) is the same value as the outflow integrated value of refrigerator oil in the determination of the "predetermined integrated value for oil return" in the predetermined oil return condition described above. Specifically, the outflow integrated quantity of refrigerator oil is a parameter used both in the determination of the predetermined oil return condition and the determination of the predetermined outflow condition. This outflow integrated quantity of refrigerator oil is reset by the control unit 7 and the count is restarted from 0 when the above-described oil return operation has been performed and when the above-described reverse-cycle defrost mode has been executed.

(C) Furthermore, the control unit 7 of the present embodiment determines that the predetermined outflow condition is fulfilled also when the integrated operation time of the compressor at the fulfillment of the predetermined defrosting condition is equal to or greater than a predetermined integrated operation time, which is shorter than the predetermined time deemed necessary for the predetermined oil return condition to be fulfilled. Specifically, the control unit 7 counts the integrated operation time for both the first compressor 11 and the second compressor 21, and the control unit 7 determines that the predetermined outflow condition is fulfilled when at least one of the integrated operation time for the first compressor 11 and the integrated operation time for the second compressor 21 at the fulfillment of the predetermined defrosting condition is equal to or greater than the predetermined integrated operation time.

The integrated operation time of the compressors in (C) is the same value as the integrated operation time of the compressors in the determination of the "predetermined integrated value for oil return" of the above-described predetermined oil return condition. Specifically, the integrated operation time of the compressors is a parameter used both in the determination of the predetermined oil return condition and the determination of the predetermined outflow condition. This integrated operation time of the compressors is reset by the control unit 7 and the count is restarted from 0 when the above-described oil return operation has been performed and when the above-described reverse-cycle defrost mode has been executed.

In the present embodiment, the outflow integrated value of the refrigerator oil and the integrated operation time of the compressors are reset when the reverse defrost mode has been executed and when the oil return operation has been executed but are not reset when the alternating defrost mode has been executed.

(10-2) Alternating defrost mode

The alternating defrost mode is an operation mode that causes all outdoor units to defrost by designating one of the plurality of outdoor units (the first outdoor unit 10 and the second outdoor unit 20) to be defrosted and changing what is to be defrosted in sequence.

Specifically, in the alternating defrost mode, first, the connection states of the first four-way switching valve 12 and the second four-way switching valve 22 are switched so that only one heat exchanger between the first outdoor heat exchanger 13 and the second outdoor heat exchanger 23 is to be defrosted (e.g., so that the first outdoor heat exchanger 13 is to be defrosted), and defrosting of the outdoor heat exchanger that is to be defrosted (in this example, the first outdoor heat exchanger 13) is performed. When defrosting of the outdoor heat exchanger that is the first to be defrosted (in this example, the first outdoor heat exchanger 13) has ended, next, the connection states of the first four-way switching valve 12 and the second four-way switching valve 22 are switched so that only an outdoor heat exchanger (in this example, the second outdoor heat exchanger 23) other than the outdoor heat exchanger that was the first to be defrosted is to be defrosted, and defrosting of the outdoor heat exchanger that is the heat exchanger to be newly defrosted (in this example, the second outdoor heat exchanger 23) is performed. Thus, defrosting of all of the outdoor heat exchangers is performed by the connection states of the first four-way switching valve 12 and the second four-way switching valve 22 being switched so that the outdoor heat exchanger that is to be defrosted is changed in sequence (so as to rotate through the outdoor heat exchangers to be defrosted).

When defrosting of all of the outdoor heat exchangers has ended, the connection states of the first four-way switching valve 12 and the second four-way switching valve 22 are switched and the air-warming operation is once again restarted.

Figure 4:
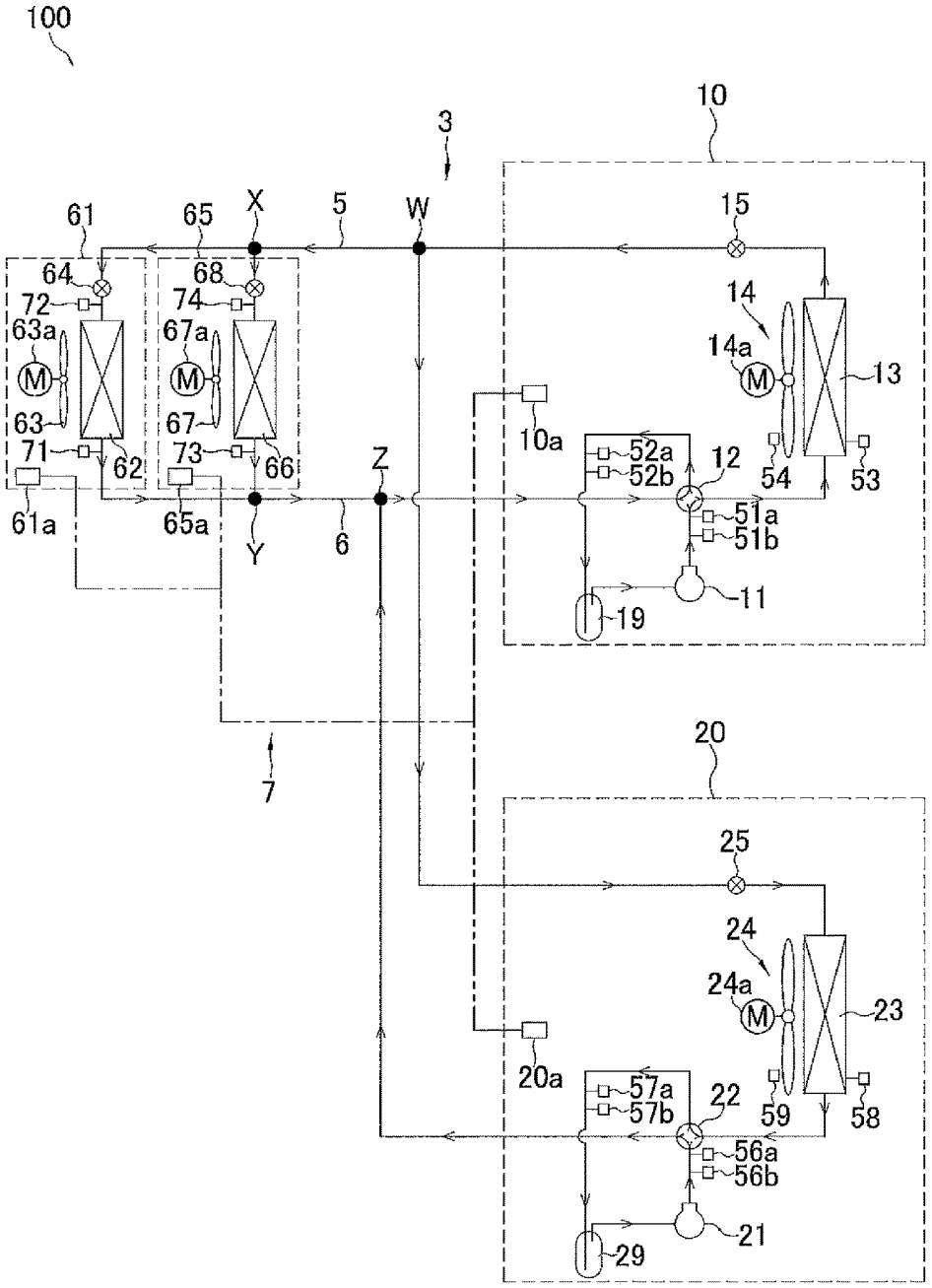
FIG. 4 shows how refrigerant flows when a first outdoor heat exchanger is to be defrosted.

(10-2-1) Operation when the first outdoor heat exchanger 13 is to be defrosted FIG. 4 shows how refrigerant flows in the refrigerant circuit 3 when the connection states of the first four-way switching valve 12 and the second four-way switching valve 22 have been switched so that the above-described first outdoor heat exchanger 13 is to be defrosted.

When the first outdoor heat exchanger 13 is to be defrosted, the connection state of the first four-way switching valve 12 is switched so that the refrigerant passing through the portion of point Z of the refrigerant circuit 3 is channeled to the intake side of the first compressor 11 and the refrigerant discharged from the first compressor 11 is sent to the first outdoor heat exchanger 13, and the connection state of the second four-way switching valve 22 is switched so that the refrigerant that has passed through the second outdoor heat exchanger 23 is channeled to the intake side of the second compressor 21 and the refrigerant discharged from the second compressor 21 is sent to the portion of point Z of the refrigerant circuit 3.

At this point, the first outdoor expansion valve 15, which is provided to the liquid side of the first outdoor heat exchanger 13, to be defrosted, is controlled by the control unit 7 so that the valve opening degree comes to be fully open.

The valve opening degree of the second outdoor expansion valve 25, which is connected to the liquid side of the second outdoor heat exchanger 23, not to be defrosted, is controlled by the control unit 7 so that the degree of superheating of the refrigerant taken in by the second compressor 21 reaches a predetermined first target degree of superheating. The control unit 7 finds the degree of superheating of the refrigerant taken in by the second compressor 21 from the temperature sensed by the second intake temperature sensor 57*a* and the pressure sensed by the second intake pressure sensor 57*b*.

The first indoor expansion valve 64 and the second indoor expansion valve 68, as is described hereinafter, are not fully closed, but are both controlled to an opening degree that enables refrigerant to pass through. Additionally, the first indoor fan motor 63*a* and/or the second indoor fan motor 67*a* are basically stopped so that the cold air in the first indoor heat exchanger 62 and/or the second indoor heat exchanger 66 functioning as evaporators is not sent into the room.

In the operation state described above, the refrigerant that has passed through point W of the refrigerant circuit 3 is decompressed to a low pressure when passing through the second outdoor expansion valve 25, evaporated in the second outdoor heat exchanger 23 functioning as an evaporator of low-pressure refrigerant, and drawn into the second compressor 21 via the second four-way switching valve 22 and the second accumulator 29.

Refrigerant compressed to an intermediate pressure in the second compressor 21 is sent to point Z of the refrigerant circuit 3 via the second four-way switching valve 22. At this point, as will be described hereinafter, because the first indoor expansion valve 64 and the second indoor expansion valve 68 are both controlled to an opening degree that enables refrigerant to pass through, refrigerant flows from the first indoor heat exchanger 62 and/or the second indoor heat exchanger 66 to the location of point Z of the refrigerant circuit 3 via the gas-side refrigerant interconnection tube 6. Therefore, at the location of point Z of the refrigerant circuit 3, the refrigerant merges and the merged refrigerant is taken into the first compressor 11 via the first four-way switching valve 12 and the first accumulator 19.

Refrigerant further compressed to a high pressure in the first compressor 11 becomes high-temperature and high-pressure refrigerant, which is supplied to the first outdoor heat exchanger 13, to be defrosted, and frost adhering to the first outdoor heat exchanger 13 can be efficiently melted. At this point, the first outdoor heat exchanger 13, which is to be defrosted, functions as a refrigerant heat radiator (condenser). High-pressure liquid refrigerant that has passed through the first outdoor heat exchanger 13 is sent to point W of the refrigerant circuit 3 after passing through the first outdoor expansion valve 15, which has been controlled to be fully open.

Because the first indoor expansion valve 64 and the second indoor expansion valve 68 have been opened, some of the high-pressure liquid refrigerant sent to point W of the refrigerant circuit 3 flows toward the first indoor heat exchanger 62 and the second indoor heat exchanger 66 via the liquid-side refrigerant interconnection tube 5 (the refrigerant is decompressed to an intermediate pressure in the first indoor expansion valve 64 and the second indoor expansion valve 68). At this point, the first indoor heat exchanger 62 and the second indoor heat exchanger 66 function as evaporators of the intermediate-pressure refrigerant. The refrigerant that has passed through the first indoor heat exchanger 62 and the second indoor heat exchanger 66 merges at point Y of the refrigerant circuit 3, after which the merged refrigerant is again sent to point Z of the refrigerant circuit 3 via the gas-side refrigerant interconnection tube 6. Additionally, the rest of the refrigerant sent to point W of the refrigerant circuit 3 is again sent to the second outdoor expansion valve 25.

In this manner is the operation performed in a case in which the first outdoor heat exchanger 13 is to be defrosted.

When a predetermined defrosting ending condition is fulfilled for the first outdoor heat exchanger 13, which is to be defrosted, i.e., when the temperature of a lower-end portion of this outdoor heat exchanger is equal to or greater than a predetermined temperature, the control unit 7 ends the defrosting of the first outdoor heat exchanger 13. To ascertain the temperature of the lower-end portion of the first outdoor heat exchanger 13, the control unit 7 may use the temperature sensed by the first outdoor heat exchange temperature sensor 53, and should a temperature sensor separate from the first outdoor heat exchange temperature sensor 53 be provided to this lower-end portion, the control unit 7 may use the temperature sensed by this temperature sensor.

Figure 5:
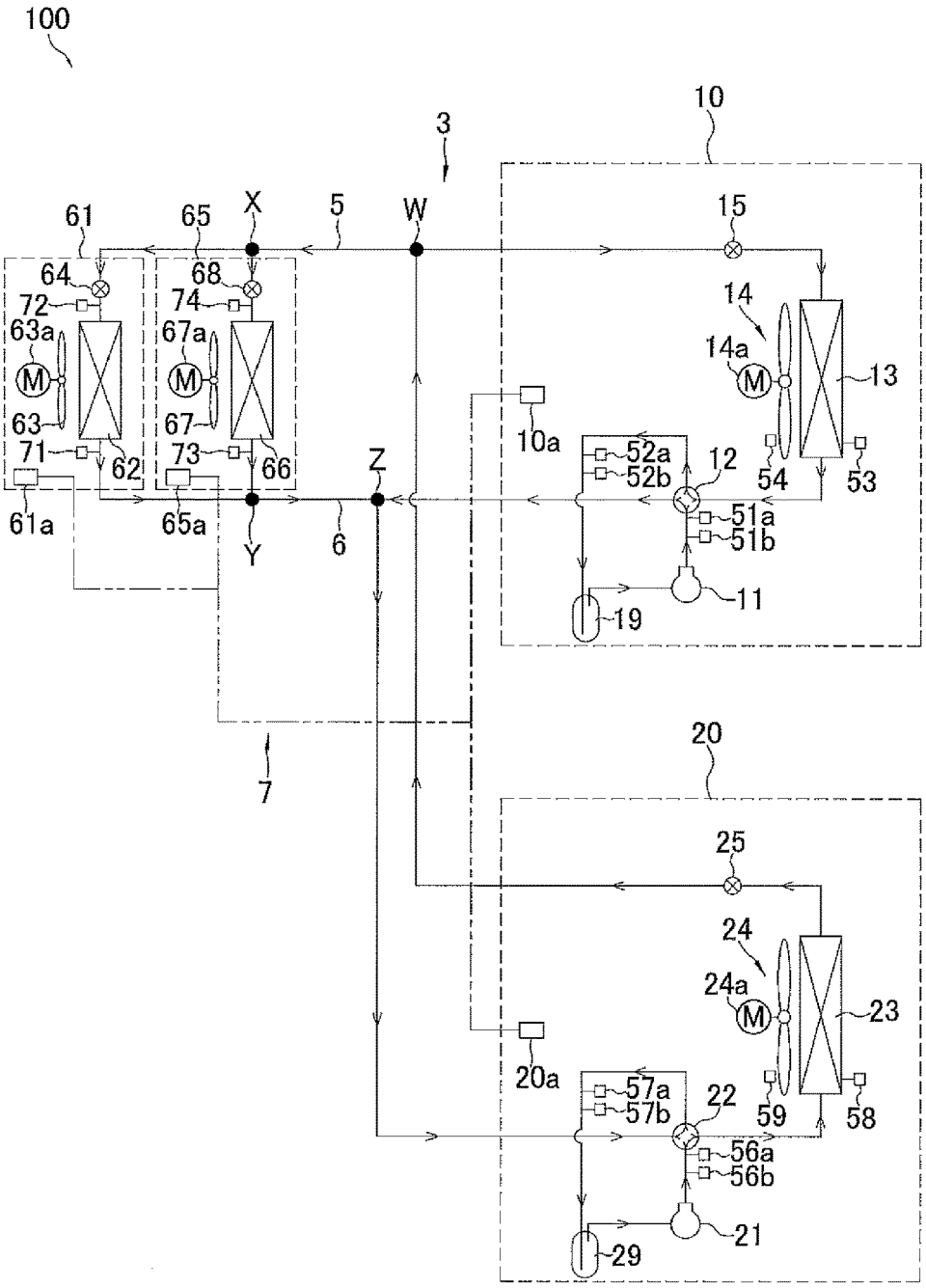
FIG. 5 shows how refrigerant flows when a second outdoor heat exchanger is to be defrosted.

(10-2-2) Operation when the second outdoor heat exchanger 23 is to be defrosted FIG. 5 shows how refrigerant flows in the refrigerant circuit 3 when the connection states of the first four-way switching valve 12 and the second four-way switching valve 22 have been switched so that the above-described second outdoor heat exchanger 23 is to be defrosted.

When the second outdoor heat exchanger 23 is to be defrosted, the connection state of the first four-way switching valve 12 is switched so that the refrigerant passing through the first outdoor heat exchanger 13 is channeled to the intake side of the first compressor 11 and the refrigerant discharged from the first compressor 11 is sent to portion of point Z of the refrigerant circuit 3, and the connection state of the second four-way switching valve 22 is switched so that the refrigerant that has passed through the portion of point Z of the refrigerant circuit 3 is channeled to the intake side of the second compressor 21 and the refrigerant discharged from the second compressor 21 is sent to the second outdoor heat exchanger 23.

At this point, the second outdoor expansion valve 25, which is provided to the liquid side of the second outdoor heat exchanger 23, which is to be defrosted, is controlled by the control unit 7 so that the valve opening degree comes to be fully open.

The valve opening degree of the first outdoor expansion valve 15, which is connected to the liquid side of the first outdoor heat exchanger 13, which is not to be defrosted, is controlled by the control unit 7 so that the degree of superheating of the refrigerant taken in by the first compressor 11 reaches the predetermined first target degree of superheating. The control unit 7 finds the degree of superheating of the refrigerant taken in by the first compressor 11 from the temperature sensed by the first intake temperature sensor 52*a* and the pressure sensed by the first intake pressure sensor 52*b*.

The first indoor expansion valve 64 and the second indoor expansion valve 68, as is described hereinafter, are not fully closed, but are both controlled to an opening degree that enables refrigerant to pass through. Additionally, the first indoor fan motor 63*a* and/or the second indoor fan motor 67*a* are basically stopped so that the cold air in the first indoor heat exchanger 62 and/or the second indoor heat exchanger 66 functioning as evaporators is not sent into the room.

In the operation state described above, the refrigerant that has passed through point W of the refrigerant circuit 3 is decompressed to a low pressure when passing through the first outdoor expansion valve 15, evaporated in the first outdoor heat exchanger 13 functioning as an evaporator of low-pressure refrigerant, and drawn into the first compressor 11 via the first four-way switching valve 12 and the first accumulator 19.

Refrigerant compressed to an intermediate pressure in the first compressor 11 is sent to point Z of the refrigerant circuit 3 via the first four-way switching valve 12. At this point, as will be described hereinafter, because the first indoor expansion valve 64 and the second indoor expansion valve 68 are both controlled to an opening degree that enables refrigerant to pass through, refrigerant flows from the first indoor heat exchanger 62 and/or the second indoor heat exchanger 66 to the location of point Z of the refrigerant circuit 3 via the gas-side refrigerant interconnection tube 6. Therefore, at the location of point Z of the refrigerant circuit 3, the refrigerant merges and the merged refrigerant is taken into the second compressor 21 via the second four-way switching valve 22 and the second accumulator 29.

Refrigerant further compressed to a high pressure in the second compressor 21 becomes high-temperature and high-pressure refrigerant, which is supplied to the second outdoor heat exchanger 23, which is to be defrosted, and frost adhering to the second outdoor heat exchanger 23 can be efficiently melted. At this point, the second outdoor heat exchanger 23, which is to be defrosted, functions as a refrigerant heat radiator (condenser). High-pressure liquid refrigerant that has passed through the second outdoor heat exchanger 23 is sent to point W of the refrigerant circuit 3 after passing through the second outdoor expansion valve 25, which has been controlled to be fully open.

Because the first indoor expansion valve 64 and the second indoor expansion valve 68 have been opened, some of the high-pressure liquid refrigerant sent to point W of the refrigerant circuit 3 flows toward the first indoor heat exchanger 62 and the second indoor heat exchanger 66 via the liquid-side refrigerant interconnection tube 5 (the refrigerant is decompressed to an intermediate pressure in the first indoor expansion valve 64 and the second indoor expansion valve 68). At this point, the first indoor heat exchanger 62 and the second indoor heat exchanger 66 function as evaporators of the intermediate-pressure refrigerant. The refrigerant that has passed through the first indoor heat exchanger 62 and the second indoor heat exchanger 66 merges at point Y of the refrigerant circuit 3, after which the merged refrigerant is again sent to point Z of the refrigerant circuit 3 via the gas-side refrigerant interconnection tube 6. Additionally, the rest of the refrigerant sent to point W of the refrigerant circuit 3 is again sent to the first outdoor expansion valve 15.

In this manner is the operation performed in a case in which the second outdoor heat exchanger 23 is to be defrosted.

When a predetermined defrosting ending condition is fulfilled for the second outdoor heat exchanger 23, which is to be defrosted, i.e., when the temperature of a lower-end portion of this outdoor heat exchanger is equal to or greater than a predetermined temperature, the control unit 7 ends the defrosting of the second outdoor heat exchanger 23. To ascertain the temperature of the lower-end portion of the second outdoor heat exchanger 23, the control unit 7 may use the temperature sensed by the second outdoor heat exchanger temperature sensor 58, and should a temperature sensor separate from the second outdoor heat exchanger temperature sensor 58 be provided to this lower-end portion, the control unit 7 may use the temperature sensed by this temperature sensor.

(10-3) Reverse-cycle defrost mode

The reverse-cycle defrost mode is an operation mode in which the connection states of the first four-way switching valve 12 and the second four-way switching valve 22 are switched so that both the first outdoor heat exchanger 13 and the second outdoor heat exchanger 23 are caused to function as refrigerant heat radiators and the first indoor heat exchanger 62 and the second indoor heat exchanger 66 are both caused to function as refrigerant evaporators, and all of the outdoor heat exchangers are simultaneously defrosted.

The specific refrigerant flow path in the refrigerant circuit 3 is the same as the refrigerant flow path during the oil return operation described above and is shown in FIG. 3.

The reverse-cycle defrost mode is an operation started when the predetermined defrosting condition has been fulfilled (furthermore, when the predetermined outflow condition has also been fulfilled) and ended when, inter alia, the temperature of the outdoor heat exchangers is equal to or greater than a predetermined temperature. The oil return operation, on the other hand, is an operation started when the predetermined oil return condition has been fulfilled and ended when a predetermined oil return ending condition has been fulfilled. These two operations differ in at least this respect.

Between the reverse-cycle defrost mode and the oil return operation, for example, the rotational speeds of the first compressor 11 and the second compressor 21 may differ and the valve opening degrees of the first indoor expansion valve 64 and the second indoor expansion valve 68 may differ. In the reverse-cycle defrost mode, operation is preferably carried out with the rotational speeds of the first compressor 11 and the second compressor 21 at a predetermined rotational speed or higher.

The reverse-cycle defrost mode is ended when the predetermined defrosting ending condition is fulfilled for both the first outdoor heat exchanger 13 and the second outdoor heat exchanger 23, i.e., when the temperatures of the lower-end portions of all of the outdoor heat exchangers are equal to or greater than a predetermined temperature; the control unit 7 ends the reverse-cycle defrost mode, switches the connection states of the first four-way switching valve 12 and the second four-way switching valve 22, and again restarts the air-warming operation.

The time to execute one reverse-cycle defrost mode is preferably longer than the operation time of one oil return operation.

Due to the execution of the reverse-cycle defrost mode described above, refrigerant can be channeled sufficiently to the liquid-side refrigerant interconnection tube 5, the first indoor unit 61, the second indoor unit 65, and the gas-side refrigerant interconnection tube 6, and refrigerator oil can be returned to the first compressor 11 and/or the second compressor 21 along with the refrigerant flow.

(11) Control flow of defrost operation

FIGS. 6, 7, 8, and 9 show the control flow of the defrost operation.

In step S10, the control unit 7 determines whether or not the air-conditioning apparatus 100 is executing the air-warming operation. At this point, the process transitions to step S11 if the air-warming operation is being executed, and the step S10 is repeated if the air-warming operation is not being executed.

In step S11, the control unit 7 determines whether or not the above-described predetermined defrosting condition has been fulfilled. Specifically, the control unit 7 transitions to step S12 when the predetermined defrosting condition has been fulfilled for at least one of the plurality of outdoor heat exchangers (the first outdoor heat exchanger 13 and the second outdoor heat exchanger 23), and repeats step S11 when the predetermined defrosting condition has not been fulfilled in any of the outdoor heat exchangers.

In step S12, the control unit 7 determines whether or not the predetermined outflow condition pertaining to the outflow integrated quantity of refrigerator oil described above has been fulfilled. Specifically, the control unit 7 determines whether or not the predetermined outflow condition pertaining to the outflow integrated quantity of refrigerator oil has been fulfilled at the point in time when the predetermined defrosting condition is fulfilled. At this point, the control unit 7 determines that the predetermined outflow condition has been fulfilled when at least any one of (A), (B), and (C) of the predetermined outflow condition has been met, as described above. Specifically, when the predetermined defrosting condition has been fulfilled in step S11, the control unit 7 determines whether or not a situation has arisen in which not only is frost adhering to the outdoor heat exchangers, but large amounts of refrigerator oil have flowed out of the compressors. At this point, when the predetermined outflow condition is determined to have not been fulfilled, the process transitions to step S13 in order to execute the alternating defrost mode (see "A1" of FIGS. 6 and 7), and when the predetermined outflow condition is determined to have been fulfilled, the process transitions to step S26 in order to execute the reverse-cycle defrost mode (see "B1" of FIGS. 6 and 9).

In step S13, the control unit 7 halts the air-warming operation and starts the execution of the alternating defrost mode. Specifically, the control unit 7 switches the connection states of the first four-way switching valve 12 and the second four-way switching valve 22 so that one of the plurality of outdoor heat exchangers is to be defrosted. There are no particular limitations as to the sequence of outdoor heat exchangers that will be the heat exchanger to be defrosted; in the present embodiment, the example described is of a case in which the first outdoor heat exchanger 13 is to be defrosted first and the second outdoor heat exchanger 23 is thereafter to be defrosted.

In step S14, the control unit 7 performs control so that the first indoor expansion valve 64 and the second indoor expansion valve 68 are opened and the valve opening degrees thereof are maintained at a predetermined initial opening degree. Specifically, the first indoor expansion valve 64 and the second indoor expansion valve 68 are not fully closed but are each ensured to be in a state such that refrigerant can pass through. There are no particular limitations as to the predetermined initial opening degree; for example, it may be a value corresponding to the capacities of the indoor heat exchangers to which the indoor expansion valves are directly connected, or, when the first indoor heat exchanger and the second indoor heat exchanger have different capacities, the predetermined initial opening degree may be set as a different opening degree according to the respective capacity of either indoor heat exchanger. Due to this configuration, from the initial state of the defrost operation, refrigerant flow in the refrigerant circuit 3 is facilitated and high-temperature and high-pressure refrigerant can be efficiently supplied to the outdoor heat exchanger that is to be defrosted.

In step S15, the control unit 7 drives the first compressor 11 and the second compressor 21, fully opens the first outdoor expansion valve 15, and controls the second outdoor expansion valve 25 so that the degree of superheating of the refrigerant taken into the second compressor 21 reaches the predetermined first target degree of superheating (see FIG. 4 and the description thereof). There are no particular limitations as to the value of this first target degree of superheating; for example, it may be greater than 0 degrees and no more than 10 degrees, but is more preferably between 3 and 5 degrees, inclusive.

In step S16, the control unit 7 determines whether or not a predetermined initial condition has been fulfilled. In this embodiment, there are no particular limitations as to the predetermined initial condition; for example, it may be a condition fulfilled when a predetermined initial time elapses from the time the first compressor 11 and the second compressor 21 start being driven while the first indoor expansion valve 64 and the second indoor expansion valve 68 have been set to the predetermined initial opening degree, or it may be a condition fulfilled when the degree of superheating of the refrigerant taken into the compressor (the first compressor 11 in this case) connected to the outdoor heat exchanger that is to be defrosted has reached a predetermined initial degree of superheating (e.g., 5 degrees or less). In this embodiment, the process transitions to step S17 if the predetermined initial condition has been fulfilled, and step S16 is repeated when the predetermined initial condition has not been fulfilled.

In step S17, while continuing the control in step S15, the control unit 7 stops the control maintaining the first indoor expansion valve 64 and the second indoor expansion valve 68 at the predetermined initial opening degree and performs control on the valve opening degrees of the first indoor expansion valve 64 and the second indoor expansion valve 68 so that the degree of superheating of the refrigerant taken into the first compressor 11 reaches a predetermined second target degree of superheating. The value of the predetermined first target degree of superheating in step S15 and the value of the predetermined second target degree of superheating in step S17 may be the same value or different values. Presumably, in the stage of step S17, the refrigerant distribution in the refrigerant circuit 3 stabilizes as time elapses after the start of defrosting the first outdoor heat exchanger 13, and liquid compression does not occur readily; therefore, the value of the second target degree of superheating of step S17 may be less than the value of the first target degree of superheating of step S15. It is thereby possible to execute degree of superheating control with precision.

In step S18, the control unit 7 determines whether or not the predetermined defrosting ending condition has been fulfilled for the outdoor heat exchanger that is currently the heat exchanger to be defrosted. In the example of the present embodiment, a determination is made as to whether or not the predetermined defrosting ending condition has been fulfilled for the first outdoor heat exchanger 13, which was to be defrosted at first. Specifically, as described above, the predetermined defrosting ending condition is determined to be fulfilled for the first outdoor heat exchanger 13 when the temperature of the lower-end portion of the first outdoor heat exchanger 13 is equal to or greater than the predetermined temperature. When the predetermined defrosting ending condition has been fulfilled, the process transitions to step S19 (see "A2" of FIGS. 7 and 8), and when the predetermined defrosting ending condition has not been fulfilled, step S18 is repeated.

In step S19, the control unit 7 switches the connection states of the first four-way switching valve 12 and the second four-way switching valve 22 so that the outdoor heat exchanger that had up until then been the heat exchanger to be defrosted ceases to be the heat exchanger to be defrosted and an outdoor heat exchanger other than the outdoor heat exchanger that had up until then been the heat exchanger to be defrosted becomes the new heat exchanger to be defrosted. In the present embodiment, the connection states of the first four-way switching valve 12 and the second four-way switching valve 22 are switched so that the first outdoor heat exchanger 13, having finished defrosting, ceases to be the heat exchanger to be defrosted and the second outdoor heat exchanger 23 thereafter becomes the heat exchanger to be defrosted.

In step S20, similar to step S14, the control unit 7 performs control so that the first indoor expansion valve 64 and the second indoor expansion valve 68 are opened and the valve opening degrees are maintained at the predetermined initial opening degree.

In step S21, the control unit 7 drives the first compressor 11 and the second compressor 21, fully opens the second outdoor expansion valve 25, and controls the first outdoor expansion valve 15 so that the degree of superheating of the refrigerant taken into the first compressor 11 reaches the predetermined first target degree of superheating (see FIG. 5 and the description thereof). In this embodiment, the predetermined first target degree of superheating of step S21 can be, for example, a value greater than 0 degrees and no more than 10 degrees, and is preferably between 3 and 5 degrees, inclusive; it may be entirely the same value as or a different value from the predetermined first target degree of superheating of step S15.

In step S22, the control unit 7 determines whether or not a predetermined initial condition has been fulfilled. In this embodiment, there are no particular limitations as to the predetermined initial condition, as in step S16; for example, it may be a condition fulfilled when a predetermined initial time elapses from the time the first compressor 11 and the second compressor 21 start being driven while the first indoor expansion valve 64 and the second indoor expansion valve 68 have been set to the predetermined initial opening degree, or it may be a condition fulfilled when the degree of superheating of the refrigerant taken into the compressor (the second compressor 21 in this case) connected to the outdoor heat exchanger that is to be defrosted has reached a predetermined initial degree of superheating (e.g., 5 degrees or less). In this embodiment, the process transitions to step S23 if the predetermined initial condition has been fulfilled, and step S22 is repeated when the predetermined initial condition has not been fulfilled.

In step S23, while continuing the control in step S21, the control unit 7 stops the control maintaining the first indoor expansion valve 64 and the second indoor expansion valve 68 at the predetermined initial opening degree and performs control on the valve opening degrees of the first indoor expansion valve 64 and the second indoor expansion valve 68 so that the degree of superheating of the refrigerant taken into the second compressor 21 reaches the predetermined second target degree of superheating. The value of the predetermined first target degree of superheating in step S21 and the value of the predetermined second target degree of superheating in step S23 may be the same value or different values. Presumably, in the stage of step S23, the refrigerant distribution in the refrigerant circuit 3 stabilizes as time elapses after the start of defrosting the second outdoor heat exchanger 23, and liquid compression does not occur readily; therefore, the value of the second target degree of superheating of step S23 may be less than the value of the first target degree of superheating of step S21. It is thereby possible to execute degree of superheating control with precision.

In step S24, the control unit 7 determines whether or not the predetermined defrosting ending condition has been fulfilled for the outdoor heat exchanger that is currently the heat exchanger to be defrosted. In the example of the present embodiment, a determination is made as to whether or not the predetermined defrosting ending condition has been fulfilled for the second outdoor heat exchanger 23, which is to be defrosted after the first outdoor heat exchanger 13. Specifically, as described above, the predetermined defrosting ending condition is determined to be fulfilled for the second outdoor heat exchanger 23 when the temperature of the lower-end portion of the second outdoor heat exchanger 23 is equal to or greater than the predetermined temperature. When the predetermined defrosting ending condition has been fulfilled, the process transitions to step S25, and when the predetermined defrosting ending condition has not been fulfilled, step S24 is repeated.

Figure 6:
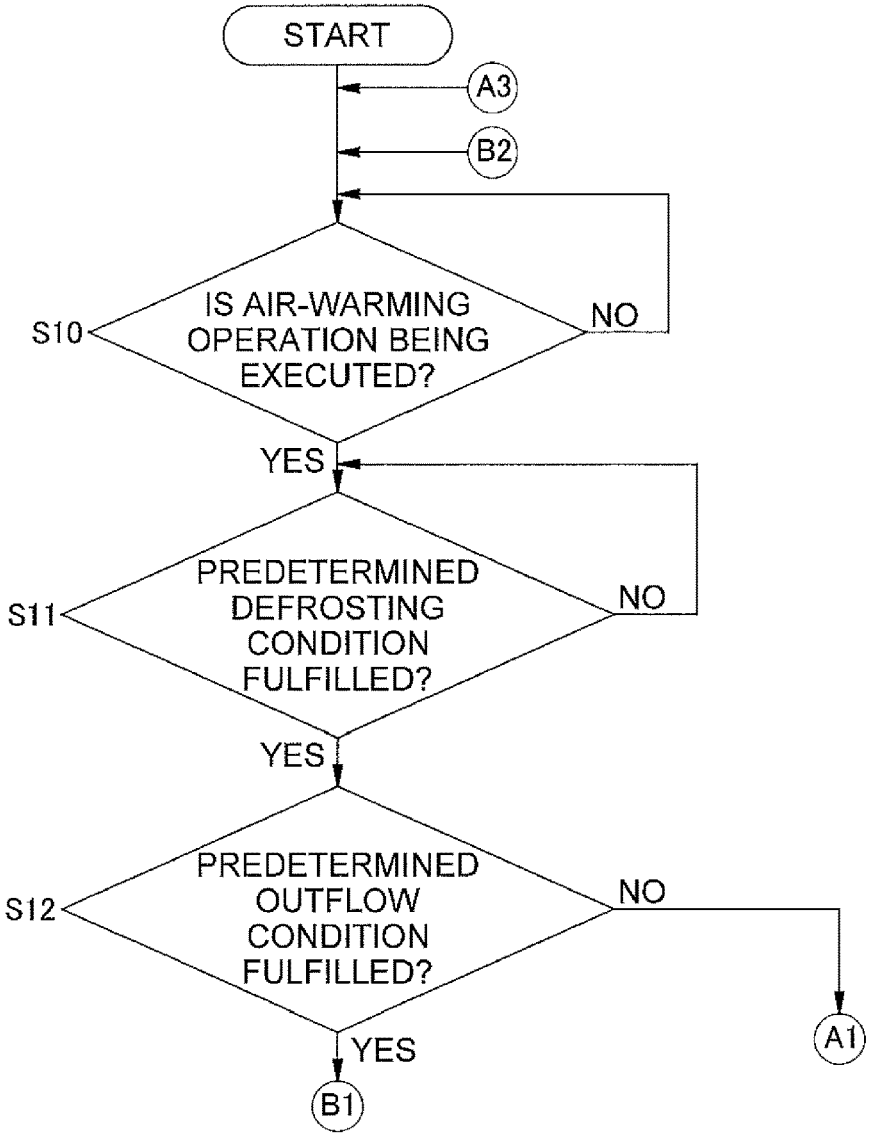
FIG. 6 is a flowchart (part 1) of the defrost operation.
Figure 7:
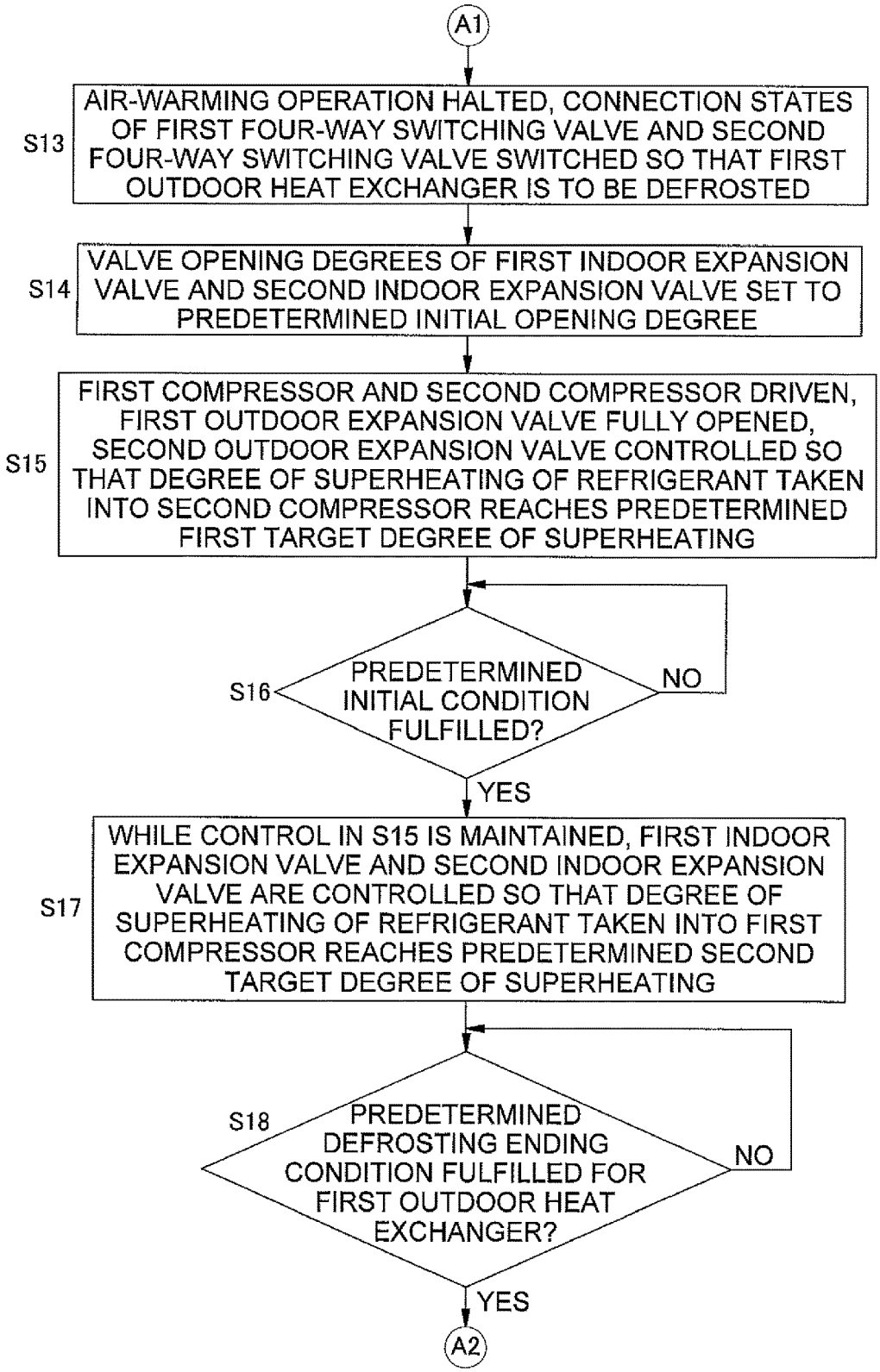
FIG. 7 is a flowchart (part 2) of the defrost operation.
Figure 8:
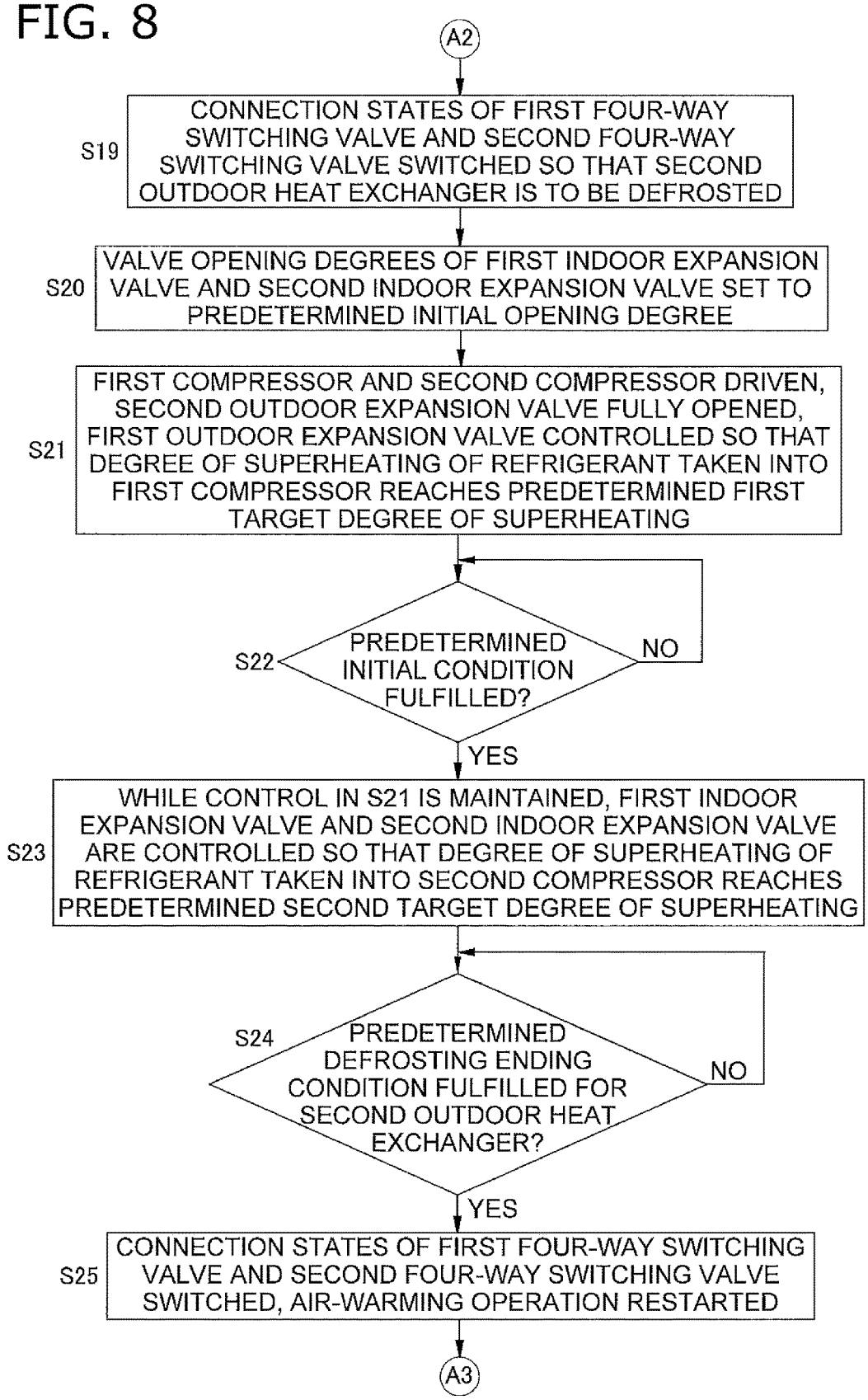
FIG. 8 is a flowchart (part 3) of the defrost operation.

In step S25, the control unit 7 switches the connection states of the first four-way switching valve 12 and the second four-way switching valve 22, which had made the second outdoor heat exchanger 23 the heat exchanger to be defrosted, to the connection states for performing the air-warming operation, restarts the air-warming operation, and returns to step S10 (see "A3" of FIGS. 8 and 6).

In step S26, the control unit 7 halts the air-warming operation and starts execution of the reverse-cycle defrost mode. Specifically, the control unit 7 switches the connection states of the first four-way switching valve 12 and the second four-way switching valve 22 so that all of the plurality of outdoor heat exchangers (the first outdoor heat exchanger 13 and the second outdoor heat exchanger 23) function as refrigerant heat radiators and all of the plurality of indoor heat exchangers (the first indoor heat exchanger 62 and the second indoor heat exchanger 66) function as refrigerant evaporators. The connection states of the first four-way switching valve 12 and the second four-way switching valve 22 are the same as the connection states in the oil return operation (see FIG. 3 and the description thereof).

In step S27, the control unit 7 drives the first compressor 11 and the second compressor 21. Furthermore, the control unit 7 performs control on the valve opening degrees of the first indoor expansion valve 64 and the second indoor expansion valve 68 so that the degrees of superheating of the refrigerant taken into the first compressor 11 and the second compressor 21 will be equal to or greater than a predetermined third target degree of superheating (control is performed so that the degrees of superheating reach a value, e.g., greater than 0 degrees and no more than 10 degrees). Though no particular limitation is provided hereby, the control unit 7 may perform control so as to, inter alia, increase the valve opening degree of whichever is smaller between the valve opening degree of the first indoor expansion valve 64 and the valve opening degree of the second indoor expansion valve 68 when, for example, either one or both of the degree of superheating of the refrigerant taken into the first compressor 11 and the degree of superheating of the refrigerant taken into the second compressor 21 is/are less than the predetermined third target degree of superheating. At this point, the control unit 7 controls the first outdoor expansion valve 15 and the second outdoor expansion valve 25 to both be fully open.

In step S28, the control unit 7 determines whether or not the predetermined defrosting ending condition has been fulfilled for all of the outdoor heat exchangers (both the first outdoor heat exchanger 13 and the second outdoor heat exchanger 23). Specifically, the control unit 7 determines that the predetermined defrosting ending condition has been fulfilled when the temperature of the lower-end portion of the first outdoor heat exchanger 13 is equal to or greater than a predetermined temperature and the temperature of the lower-end portion of the second outdoor heat exchanger 23 is also equal to or greater than a predetermined temperature. At this point, when the predetermined defrosting ending condition is determined to have been fulfilled, the process transitions to step S29, and when the predetermined defrosting ending condition is determined to have not been fulfilled, step S28 is repeated. Due to the execution of the reverse-cycle defrost mode in this manner, when operation has been performed until the temperatures of the lower-end portions of the outdoor heat exchangers come to be equal to or greater than the predetermined temperatures, presumably, refrigerant will have already sufficiently flowed within the refrigerant circuit 3 and the refrigerator oil that has flowed out to the liquid-side refrigerant interconnection tube 5, the first indoor unit 61, the second indoor unit 65, and/or the gas-side refrigerant interconnection tube 6 will have already sufficiently returned to the first compressor 11 and/or the second compressor 21.

In step S29, because the refrigerator oil in the refrigerant circuit 3 presumably will have sufficiently returned to the first compressor 11 and/or the second compressor 21 due to the execution of the reverse-cycle defrost mode, the control unit 7 resets (to 0) both the outflow integrated quantity of refrigerator oil for the first compressor 11 and the outflow integrated quantity of refrigerator oil for the second compressor 21 at this point in time. Furthermore, the control unit 7 resets (to 0) both the integrated operation time of the first compressor 11 and the integrated operation time of the second compressor 21. Specifically, this resetting is similar to when the predetermined oil return condition is fulfilled and the oil return operation is performed.

Figure 9:
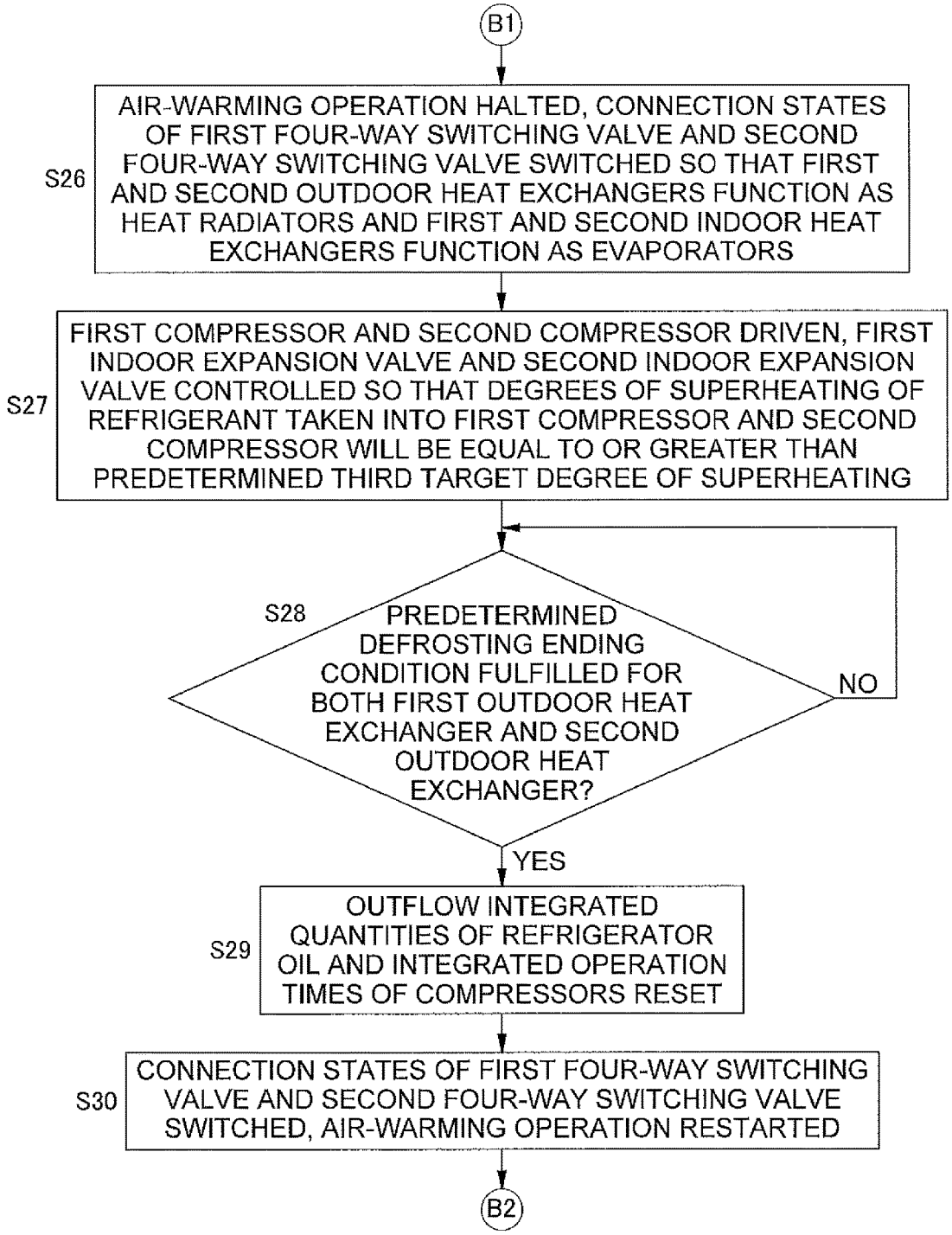
FIG. 9 is a flowchart (part 4) of the defrost operation.

In step S30, the control unit 7 switches the first four-way switching valve 12 and the second four-way switching valve 22, which had been in connection states causing the first outdoor heat exchanger 13 and the second outdoor heat exchanger 23 to function as heat radiators and the first indoor heat exchanger 62 and the second indoor heat exchanger 66 to function as evaporators, to connection states for performing the air-warming operation, restarts the air-warming operation, and returns to step S10 (see "B2" of FIGS. 9 and 6).

(12) Characteristics (12-1)

In the air-conditioning apparatus 100 of the present embodiment, when the predetermined defrosting condition is fulfilled and the predetermined outflow condition has not been fulfilled, the "reverse-cycle defrost," in which all of the outdoor heat exchangers are caused to function as refrigerant condensers and all of the indoor heat exchangers are caused to function as refrigerant evaporators, is not performed, but an alternating defrost mode is executed, in which defrosting of all of the outdoor heat exchangers is performed by setting one of the plurality of outdoor heat exchangers as a heat exchanger to be defrosted and then changing what is to be defrosted. In this alternating defrost mode, an outdoor heat exchanger other than that which is to be defrosted is caused to function as an evaporator of refrigerant at a low pressure and the indoor heat exchangers are caused to function as evaporators at an intermediate pressure, which is the pressure once the low-pressure refrigerant has been compressed (the pressure of the refrigerant compressed by the compressor connected to the outdoor heat exchanger that is not the heat exchanger to be defrosted), whereby the evaporation of refrigerant in the indoor heat exchangers can be suppressed to a smaller amount in comparison with the reverse defrost mode in which only the indoor heat exchangers function as evaporators of the refrigerant at a low pressure. Therefore, it is possible for the decrease in the indoor temperature during execution of the alternating defrost mode to be suppressed to a small decrease.

In the alternating defrost mode, all of the outdoor heat exchangers are defrosted by performing defrosting with the plurality of the outdoor heat exchangers designated as heat exchangers to be defrosted in sequence. Therefore, every time there is an outdoor heat exchanger in which the predetermined defrosting condition has been fulfilled, the frequency with which the air-warming operation is interrupted can be suppressed in comparison with when the air-warming operation is interrupted to perform the defrost operation.

(12-2)

In the case of an apparatus that, for example, does not selectively execute the alternating defrost mode and the reverse-cycle defrost mode but instead executes only the reverse-cycle defrost mode when the predetermined defrosting condition is fulfilled, it would be possible for the refrigerator oil flowing out of the compressors to other locations in the refrigerant circuit 3 to be returned to the compressors every time the predetermined defrosting condition is fulfilled and the reverse-cycle defrost mode is executed.

However, when the alternating defrost mode is executed, a large amount of refrigerant would flow between the outdoor units (between the first outdoor unit 10 and the second outdoor unit 20), and in the liquid-side refrigerant interconnection tube 5, the first indoor unit 61, the second indoor unit 65, and the gas-side refrigerant interconnection tube 6, not as much refrigerant would flow as during execution of the reverse-cycle defrost mode.

In the alternating defrost mode, because at first the component to be defrosted is either the first outdoor unit 10 or the second outdoor unit 20, even if some amount of refrigerator oil could be returned, it would be returned in an unequal amount to the outdoor unit that is to be defrosted at first.

Furthermore, in the alternating defrost mode of the present embodiment, the first indoor expansion valve 64 and the second indoor expansion valve 68 are opened, damp refrigerant can flow in the liquid sides of the first indoor heat exchanger 62 and the second indoor heat exchanger 66 and in the liquid-side refrigerant interconnection tube 5, and refrigerator oil can flow together with this damp refrigerant. However, at point Z of the refrigerant circuit 3, refrigerant that has flowed together with refrigerator oil in the gas-side refrigerant interconnection tube 6 merges with refrigerant discharged from the compressor of the outdoor unit on the low-stage compression side (in the above example, the second compressor 21 of the second outdoor unit 20). Therefore, there are cases in which the refrigerant flowing between point Z of the refrigerant circuit 3 and the intake side of the compressor of the outdoor unit on the high-stage compression side (in the above example, the first compressor 11 of the first outdoor unit 10) cannot be dampened, and there are cases in which refrigerator oil cannot be made to flow with the refrigerant.

Therefore, it is difficult for refrigerator oil flowing out of the compressors to other locations in the refrigerant circuit 3 to be sufficiently returned to the compressors by merely performing the alternating defrost mode every time the predetermined defrosting condition is fulfilled.

To address this problem, in the air-conditioning apparatus 100 of the embodiment described above, when the predetermined defrosting condition has been fulfilled and the predetermined outflow condition pertaining to the outflow integrated quantity of refrigerator oil has also been fulfilled, the alternating defrost mode is not executed, but rather the reverse-cycle defrost mode is executed, whereby it is possible for refrigerator oil flowing out of the compressors to other locations in the refrigerant circuit 3 to be sufficiently returned to the compressors while defrosting of the outdoor heat exchangers is performed.

The predetermined outflow condition pertaining to the outflow integrated quantity of refrigerator oil is that, assuming that a predetermined operation, in which the first compressor 11 and the second compressor 21 both discharge the largest amounts of oil, will be continually executed from the point in time when the predetermined defrosting condition is fulfilled, the time needed to reach a "predetermined state of oil depletion" from the point in time when the predetermined defrosting condition is fulfilled (the time needed for at least one of the first compressor 11 and the second compressor 21 to reach a predetermined state of oil depletion) is equal to or less than a predetermined time. In this embodiment, control is performed with the "predetermined state of oil depletion" having been established as a state of oil depletion to the extent that a predetermined oil return condition is fulfilled (for example, a state in which the outflow integrated value of refrigerator oil for the first compressor 11 or the second compressor 21 exceeds a predetermined integrated value for oil return), whereby, in such cases as when the predetermined defrosting condition has been fulfilled and the predetermined oil return condition would also be fulfilled with a little more time (when the predetermined outflow condition is fulfilled), it is possible for refrigerator oil to be sufficiently returned to the compressors not by executing the alternating defrost mode, which does not yield an oil return effect, but by executing the reverse-cycle defrost mode.

In this case, because the outflow integrated quantity of refrigerator oil is reset and the integrated operation time is also reset, the predetermined oil return condition is not fulfilled immediately after the reverse-cycle defrost mode is executed. Therefore, situations in which the defrost operation and the oil return operation are continuously performed can be avoided, and it is possible to avoid circumstances in which the air-warming operation is not performed for a long period of time.

Specifically, if the alternating defrost mode is executed in cases such as when control such as that of the above embodiment is not performed but rather, for example, the predetermined defrosting condition has been fulfilled and the predetermined oil return condition would also be fulfilled with a little more time (cases in which the predetermined outflow condition is fulfilled), there are cases in which the oil return affect is not achieved, neither the outflow integrated quantity of refrigerator oil nor the integrated operation time is reset, and the predetermined oil return condition is therefore fulfilled immediately after the alternating defrost mode is executed. In these cases, a problem arises in that the alternating defrost mode and the oil return operation are continuously performed and the air-warming operation is not performed for a long period of time. Because the reverse-cycle defrost mode is executed in the above embodiment as a countermeasure, it is possible to avoid this problem.

(12-3)

Moreover, in the air-conditioning apparatus 100 of the above embodiment, execution of the reverse-cycle defrost mode when the predetermined defrosting condition is fulfilled is limited to cases in which the predetermined outflow condition is also fulfilled, otherwise the alternating defrost mode is preferentially executed.

It is thereby possible to avoid temperature decreases in the indoor heat exchangers such as occur when the reverse-cycle defrost mode is executed, and to sooner start supplying warm air to the space to be air-conditioned in the air-warming operation, which is restarted after the defrost operation has ended.

(12-4)

In the present embodiment, when the alternating defrost mode is executed, refrigerant can be compressed in multiple stages, with the compressor of the outdoor unit that is not to be defrosted as the low-stage-side compressor and the compressor of the outdoor unit that is to be defrosted as the high-stage-side compressor. Because high-temperature refrigerant thus compressed in multiple stages can be supplied to the outdoor heat exchanger that is to be defrosted, defrosting can be performed efficiently.

(13) Other embodiments

In the above embodiment, an example of an embodiment of the present invention was described, but the above embodiment is in no way intended to limit the present invention, nor is the above embodiment provided by way of limitation. The present invention naturally includes forms that have been appropriately modified without deviating from this intention.

(13-1) Other embodiment A

In the above embodiment, a case in which two outdoor units are connected in parallel to an indoor unit was described as an example.

Conversely, for example, the number of outdoor units connected in parallel to an indoor unit is not limited to two; for example, three or more outdoor units may be connected in parallel to an indoor unit.

In this case, when alternating defrosting is performed, all of the outdoor heat exchangers may be defrosted by setting one outdoor heat exchanger as the heat exchanger to be defrosted and changing the one outdoor heat exchanger that is to be defrosted. Another option is to defrost all of the outdoor heat exchangers by setting a plurality of outdoor heat exchangers as heat exchangers to be defrosted and changing the plurality of outdoor heat exchangers to be defrosted.

(13-2) Other embodiment B

In the above embodiment, an example was described in which, when the alternating defrost mode is executed, the first indoor expansion valve 64 and/or the second indoor expansion valve 68 are maintained at a predetermined initial opening degree and/or control corresponding to the degree of superheating is performed.

Conversely, for example, another option is to maintain the first indoor expansion valve 64 and the second indoor expansion valve 68 at fully closed when the alternating defrost mode is executed.

In this case, refrigerant would not flow to the liquid-side refrigerant interconnection tube 5, the first indoor unit 61, the second indoor unit 65, and the gas-side refrigerant interconnection tube 6 when the alternating defrost mode is executed. However, it would be possible to return the refrigerator oil in the refrigerant circuit 3 to the compressors by executing the reverse-cycle defrost mode when the predetermined defrosting condition is fulfilled and the predetermined outflow condition is fulfilled as well.

(13-3) Other embodiment C

In the above embodiment, a case in which whether or not the predetermined outflow condition is fulfilled is determined was described as an example.

However, this example of the predetermined outflow condition is not provided by way of limitation.

For example, a specific two of the three conditions (A), (B), and (C) of the predetermined outflow condition described in the above embodiment may be used in the determination of whether or not the predetermined outflow condition is fulfilled, or a specific one may be used in the determination of whether or not the predetermined outflow condition is fulfilled.

For example, in a case in which the predetermined oil return condition is deemed fulfilled when any of a plurality of parameters meets a predetermined condition in the determination for the predetermined oil return condition, the control unit 7 may determine that the predetermined outflow condition is met when any of the plurality of parameters exceeds an outflow determination threshold value that is smaller than the value at which the predetermined oil return condition is deemed fulfilled. In this case as well, circumstances in which the air-warming operation is not performed for a long period of time can be avoided by executing the reverse-cycle defrost mode and continuously performing the oil return operation.

(13-4) Other embodiment D

In the above embodiment, an example was described of a case in which, as the oil return operation performed when the predetermined oil return condition is fulfilled, an operation is performed in which the first four-way switching valve 12 and the second four-way switching valve 22 are set to the same connection states as the reverse-cycle defrost mode and refrigerant flows in the refrigerant circuit 3.

Conversely, this configuration for the oil return operation performed when the predetermined oil return condition is fulfilled is not provided by way of limitation.

For example, instead of the oil return operation of the above embodiment, an operation may be performed in which, with the connection states of the first four-way switching valve 12 and the second four-way switching valve 22 maintained at the connection states of the air-warming operation, the rotational speeds of the first compressor 11 and the second compressor 21 are increased, and the flow rate of refrigerant passing through the refrigerant circuit 3 is increased.

For example, instead of the oil return operation of the above embodiment, an operation may be performed in which, with the connection states of the first four-way switching valve 12 and the second four-way switching valve 22 maintained at the connection states of the air-warming operation, the valve opening degrees of the first indoor expansion valve 64 and the second indoor expansion valve 68 are increased, and damp refrigerant flows to the liquid-side refrigerant interconnection tube 5, whereby refrigerator oil and liquid refrigerant together are returned to the first compressor 11 and the second compressor 21.

Furthermore, for example, instead of the oil return operation of the above embodiment, an operation may be performed in which the connection states of the first four-way switching valve 12 and the second four-way switching valve 22 are the same as those of the oil return operation of the above embodiment, the valve opening degrees of the first indoor expansion valve 64 and the second indoor expansion valve 68 are increased, and damp refrigerant flows to the gas-side refrigerant interconnection tube 6, whereby refrigerator oil and liquid refrigerant together are returned to the first compressor 11 and the second compressor 21.

(13-4) Other embodiment D

In the above embodiment, an example was described of a case in which, in steps S15, S17, S21, S23, and S27, and the degree of superheating control of the oil return operation, focus is on the degrees of superheating of the refrigerant taken in by the compressors and opening degree control for the expansion valves is performed so as to meet a predetermined condition.

Conversely, for example, in the above-listed steps and control, opening degree control for the expansion valves may be performed so that the degrees of superheating of the refrigerant discharged from the compressors, rather than the degrees of superheating of the refrigerant taken in by the compressors, meet a predetermined condition. There would be no particular limitations as to the degrees of superheating of the refrigerant discharged from the compressors in this case; for example, they may be found by the control unit 7 from the temperature sensed by the first discharge temperature sensor 51*a* and the pressure sensed by the first discharge pressure sensor 51*b*, or they may be found by the control unit 7 from the temperature sensed by the second discharge temperature sensor 56*a* and the pressure sensed by the second discharge pressure sensor 56*b*.

INDUSTRIAL APPLICABILITY

The refrigeration apparatus described above is particularly useful as a refrigeration apparatus in which a plurality of outdoor units are provided, because the decrease in the temperature of an indoor heat exchanger can be suppressed as much as possible while suppressing depletion of refrigerator oil in a compressor.

REFERENCE SIGNS LIST

3 Refrigerant circuit
7 Control unit
10 First outdoor unit (outdoor unit)
10*a* First outdoor-side control board (control unit)
11 First compressor (compressor)
12 First four-way switching valve (switching valve)
13 First outdoor heat exchanger (outdoor heat exchanger)
15 First outdoor expansion valve (outdoor expansion valve)
20 Second outdoor unit (outdoor unit)
20*a* Second outdoor-side control board (control unit)
21 Second compressor (compressor)
22 Second four-way switching valve (switching valve)
23 Second outdoor heat exchanger (outdoor heat exchanger)
25 Second outdoor expansion valve (outdoor expansion valve)
61 First indoor unit (indoor unit)
61*a* First indoor-side control board (control unit)
62 First indoor heat exchanger (indoor heat exchanger)
64 First indoor expansion valve (indoor expansion valve)
65 Second indoor unit (indoor unit)
65*a* Second indoor-side control board (control unit)
66 Second indoor heat exchanger (indoor heat exchanger)
68 Second indoor expansion valve (indoor expansion valve)
100 Air-conditioning apparatus (refrigeration apparatus)

CITATION LIST

Patent Literature

Patent Literature 1: Japanese Laid-open Patent Publication No. 2008-25919

The invention claimed is:

1. A refrigeration apparatus configured from a parallel connection of a plurality of outdoor units to an indoor unit, the refrigeration apparatus comprising:
   - a refrigerant circuit capable of executing at least an air-warming operation and configured from a connection of:
     - an indoor heat exchanger provided to the indoor unit; and
     - an outdoor heat exchanger, a compressor, and a switching valve provided to each of the plurality of outdoor units; and
   - a controller including at least one processor programmed to selectively execute one of the following when a predetermined defrosting condition is fulfilled during execution of the air-warming operation:
     - an alternating defrost mode in which an operation, which is performed with the switching valves having been connected such that at least one of the outdoor heat exchangers of the plurality of outdoor units is caused to function as evaporator, while one or more outdoor heat exchangers of the rest of the plurality of outdoor units is designated as a component to be defrosted and thereby caused to function as condenser, is executed, wherein the one or more outdoor heat exchangers designated as a component to be defrosted is switched during the alternating defrost mode; and
     - a reverse-cycle defrost mode executed with the switching valves having been connected such that the outdoor heat exchangers of the outdoor units are caused to function as condensers and the indoor heat exchanger is caused to function as an evaporator, wherein the at least one processor is further programmed to, when the predetermined defrosting condition has been fulfilled, selectively execute one of the reverse-cycle defrost mode and the alternating defrost mode on a basis of whether or not a predetermined outflow condition pertaining to a determined value of an outflow integrated quantity of refrigerator oil has also been fulfilled, such that the reverse-cycle defrost mode is executed if the predetermined outflow condition has been fulfilled, and the alternating defrost mode is executed if the predetermined outflow condition has not been fulfilled.

2. The refrigeration apparatus according to claim 1, wherein fulfillment of the predetermined outflow condition refers to:

an instance in which the determined value of the outflow integrated quantity of the refrigerator oil, which is determined when the predetermined defrosting condition has been fulfilled, and which is determined on the basis of a rotational speed of at least one of the compressors in the plurality of outdoor units and a high pressure and a low pressure of the refrigerant circuit, is equal to or greater than a predetermined integrated value.

3. The refrigeration apparatus according to claim 2, wherein the at least one processor is programmed to determine whether the predetermined outflow condition is fulfilled or not by using the determined value of the outflow integrated quantity of the refrigerator oil, resets the determined value when the reverse-cycle defrost mode has been executed, and starts integration anew.

4. The refrigeration apparatus according to claim 1, wherein the at least one processor is programmed to determine whether the predetermined outflow condition is fulfilled or not by using the determined value of the outflow integrated quantity of the refrigerator oil, resets the determined value when the reverse-cycle defrost mode has been executed, and starts integration anew.

* * * * *